US006983899B2

(12) United States Patent
Melendez

(10) Patent No.: US 6,983,899 B2
(45) Date of Patent: Jan. 10, 2006

(54) HANDHELD PAINT SPRAYING APPARATUS WITH ANTI-SPUTTER SPRAY NOZZLE

(76) Inventor: Henry D. Melendez, 8538 Creekwood Way, Fair Oaks, CA (US) 95628

( * ) Notice: Subject to any disclaimer, the term of this patent is extended or adjusted under 35 U.S.C. 154(b) by 0 days.

(21) Appl. No.: 10/609,139

(22) Filed: Jun. 27, 2003

(65) Prior Publication Data

US 2004/0124284 A1 Jul. 1, 2004

Related U.S. Application Data

(60) Provisional application No. 60/437,365, filed on Dec. 31, 2002.

(51) Int. Cl.

| | |
|---|---|
| ***A62C 2/08*** | (2006.01) |
| ***A62C 37/08*** | (2006.01) |
| ***B05B 1/14*** | (2006.01) |
| ***E21F 5/04*** | (2006.01) |
| ***F23D 11/38*** | (2006.01) |

(52) U.S. Cl. ..... 239/548; 239/280; 239/280.5; 239/281; 239/525; 118/315; 118/317; 427/421; 427/427

(58) Field of Classification Search ..... 239/280, 239/280.5, 281, 525, 548; 118/315, 317, 118/323; 427/421
See application file for complete search history.

(56) References Cited

U.S. PATENT DOCUMENTS

| | | | | |
|---|---|---|---|---|
| 2,572,142 A | | 10/1951 | Hartenbach, Jr. | |
| 2,581,678 A | | 1/1952 | Malin et al. | |
| 2,605,138 A | | 7/1952 | Paasche | |
| 3,061,201 A | | 10/1962 | Rienecker | |
| 3,219,276 A | | 11/1965 | Norris | |
| 3,237,346 A | | 3/1966 | Watts | |
| 3,729,018 A | | 4/1973 | Butterfield | |
| 3,788,273 A | | 1/1974 | Tusch et al. | |
| 3,831,848 A | * | 8/1974 | Cook | 239/104 |
| 3,894,556 A | | 7/1975 | Pareja | |
| 3,936,002 A | | 2/1976 | Geberth, Jr. | |
| 4,344,991 A | | 8/1982 | Gray | |
| 4,479,610 A | * | 10/1984 | Etheridge et al. | 239/171 |
| 4,667,878 A | | 5/1987 | Behr | |
| 4,793,559 A | | 12/1988 | Marlek | |

(Continued)

FOREIGN PATENT DOCUMENTS

| | | |
|---|---|---|
| IT | 648091 | 10/1962 |

*Primary Examiner*—David A. Scherbel
*Assistant Examiner*—James S. Hogan
(74) *Attorney, Agent, or Firm*—John P. O'Banion

(57) ABSTRACT

A fluid spray apparatus with a controlled supply of pressurized fluid delivered through a network of tubes to a spray head having a plurality of stop flow valves and nozzles that will automatically shut off the flow of fluid out of the nozzles when the pressure of the fluid drops below a threshold level. The spray head preferably has a central chamber that is open to the stop flow valves and dampens any fluctuations in pressure and volume of fluid from the source of pressurized fluid. The nozzle is preferably mounted to the stop flow valve. The stop flow valve has a biased valve head that engages a seat until the pressure exerted on the valve head by the fluid exceeds a threshold level and the valve opens. One embodiment has a quick connect coupling with a base, seal and collar that will allow spray heads of various numbers of nozzles to be quickly exchanged. Another embodiment is adapted to couple with a conventional paint spray compressor and gun.

44 Claims, 19 Drawing Sheets

U.S. PATENT DOCUMENTS 5,183,075 A 2/1993 Stein
5,295,626 A 3/1994 Mirabito
5,494,228 A 2/1996 Eaton et al.
5,935,657 A * 8/1999 Melendez ..... 427/427.1

* cited by examiner

HANDHELD PAINT SPRAYING APPARATUS WITH ANTI-SPUTTER SPRAY NOZZLE

CROSS-REFERENCE TO RELATED APPLICATIONS

This application claims priority from U.S. provisional application Ser. No. 60/437,365 filed on Dec. 31, 2002, incorporated herein by reference.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention pertains to pressurized fluid spraying systems, and more particularly to a handheld paint spraying apparatus having anti-sputter valve components that stop the flow of fluid through the nozzle when the pressure of the fluid drops below an adjustable threshold level.

2. Description of Related Art

Painting architectural structures can be an extremely labor and time intensive activity. The fees charged for painting the interior or exterior of a building, for example, are based primarily on the time it takes a painter to complete the project as well as the cost of materials. Accordingly, it is beneficial to increase a painter's efficiency so as to reduce the overall time spent on a project by the painter and thereby reduce the labor costs of a project.

One conventional approach to painting walls or structures has been to use a paintbrush. However, the brush approach can be prohibitively expensive, especially if the structure has a large surface area for the painter to paint. To complete the task with a paintbrush, the painter is required to use many repetitive strokes, and the brush has to be continually rewetted after the paint is applied to the surface. In addition, the amount of surface area that can be covered by a given stroke of the paintbrush is limited to the width of the brush.

Another conventional approach, which is an improvement over using a paintbrush, is using a paint roller. In most aspects, using a paint roller is similar to using a paint brush (i.e. repetitive strokes and continual rewetting); however, the main advantage that a paint roller has over a paint brush is that the roller's width is generally greater than that of a paint brush, thus allowing the painter to cover more surface area with a given stroke.

A painter's application efficiency when using a paint roller was improved by the introduction of rollers with a pressurized paint supply feeding the roller mechanism through a tube. The pressurized paint supply in these devices eliminated the need to continually rewet the roller, thus saving valuable time. However, the amount of surface area that can be painted with any given stroke of the roller is still limited by the width of the roller.

Paint sprayers were developed as an improvement over the pressurized roller approach and have a substantially larger covering stroke than the roller. A paint sprayer allows a painter to paint a significantly larger surface area in less time than with a pressurized roller, particularly when painting large wall or ceiling areas that require an even, uniform coating of paint. Note, however, that defects and an uneven application of paint will be particularly noticeable on long walls and ceilings. Therefore, one disadvantage associated with the use of paint sprayers is that a less than uniform coat of paint may often be applied to the surface by any single pass of the sprayer. The painter is required to hold the spray nozzle, aim it at the surface to be painted, and physically move the spray nozzle along the front of the surface, usually back and forth vertically or horizontally. If the painter varies the pace at which the spray nozzle moves across the surface, varies the distance of the nozzle from the surface or varies the angle of the nozzle relative to the surface, a non-uniform coat of paint may result. This condition requires the painter to spray the surface with another coat until a uniform coat is achieved. In addition to wasting time, this repetitive process also wastes paint, and unnecessarily adds to the expense of completing the project.

Another significant disadvantage demonstrated by some single and multiple nozzle sprayers is that the paint may sputter or spurt from the nozzle after the source of pressurized paint has been shut off due to residual pressure in the system. Similar problems of excess fluid escaping the nozzles are also experienced with other pressurized fluid spraying systems used in manufacturing industries and the like. When the pressure in the system and the distance between the control valve and the nozzle increase, the amount of sputtering experienced by the sprayer increases. Sputtering creates defects in the painted surface that must be removed and/or repainted.

Spraying devices with banks of anti-sputter spray nozzles have been developed to improve the application time and consistency of the layers of applied paint. For example, U.S. Pat. No. 5,935,657, incorporated herein by reference, describes a multiple nozzle paint spraying system mounted to a portable stand that permits the moving the system along a floor surface for painting large wall and ceiling areas. However, the device is not adapted for handheld use.

Accordingly, there is a need for a handheld paint spraying system that allows a painter to work more efficiently by applying paint quickly and uniformly without sputtering, thereby allowing the painter to save time, effort and paint. The present invention satisfies those needs, as well as others, and generally overcomes the deficiencies found in the background art.

BRIEF SUMMARY OF THE INVENTION

The present invention generally comprises a handheld paint spraying apparatus wherein anti-sputter valve components are associated with the spray nozzles. The anti-sputter valve components or "stop flow valves" are configured to immediately stop the flow of paint when the fluid pressure in the valve drops below a threshold level. These stop flow valves contain improvements over the prior valve shown in U.S. Pat. No. 5,935,657 such as, for example, means for adjusting the bias to set different threshold pressures. In addition, the invention includes a quick release coupling that allows a spray head assembly to be quickly exchanged for another without the need for tools and that does not leak during transportation or storage after exchange, as well as a balanced handle assembly for supporting the spray head.

By way of example, and not of limitation, in accordance with one aspect of the invention, a fluid spraying apparatus is provided for use with a controlled supply of pressurized fluid wherein the apparatus includes a delivery network of tubes to deliver fluid to a nozzle support member or spray head with stop flow valves and spray nozzles and that are configured to automatically shut off the flow of fluid out of the nozzles when the supply of pressurized fluid is turned off. In accordance with another aspect of the invention, the apparatus preferably has a quick connect joint that will allow different spray head assemblies to be efficiently exchanged.

In one embodiment, the apparatus is configured to attach to a conventional paint spray gun with a trigger-type flow control valve. This embodiment allows the apparatus to be used with a conventional paint compressor and gun. In another embodiment, the flow control valve of the supply of pressurized fluid is part of the tubular network that feeds the nozzles.

The invention includes a handle assembly having a feed tube that is offset an angle of approximately forty-five degrees relative to horizontal to provide for balance and positional control. The offset angle allows the user to actuate the flow control valve trigger with one hand and hold and direct the position of the apparatus with the other hand during use. The offset angle may be selected depending on the size of the spray head apparatus and the length of the feed tube. Larger spray head assemblies may have a greater offset angle, and individual nozzles may require little or no offset angle.

In another embodiment, a quick connect coupling or junction is provided that will allow spray heads of different sizes and numbers of nozzles to be quickly exchanged as the needs of the particular job change. The quick connect coupling is preferably positioned at the supply end of the handle assembly. One embodiment of the quick connect coupling is configured to receive a plug to close the end of the feed tube when the apparatus is disconnected from the source of pressurized paint such that the fluid in the feed tube and spray head will not leak out during transportation and storage of the apparatus.

The outlet end of the feed tube is preferably coupled to the spray support assembly at a perpendicular angle. The spray support assembly may be capable of rotation about the axis of the feed tube. In another embodiment, the spray support assembly is fixed in a horizontal or vertical configuration.

Larger spray head assemblies with multiple nozzles may have a handle assembly support frame or reinforcement to give the apparatus additional rigidity so that the user can accurately maneuver the nozzle head during use.

The spray head is preferably linear and can have virtually any number of nozzles and stop flow valves. In one embodiment, the spray head has a central manifold tube that feeds the individual stop flow valves and nozzles. A single feed tube is connected to the supply of pressurized fluid and preferably feeds fluid to the manifold tube of the spray head.

The preferred nozzles connect to a stop flow valve that closes when the pressure of the fluid falls below a threshold level. In one embodiment, the stop flow valve has a valve head biased against a valve seat by a spring. When the force exerted against the valve head by the pressurized fluid exceeds the opposing biasing force of the spring, the valve is open and fluid will flow through the valve. When the force of the spring on the valve head exceeds the force of the fluid then the valve closes and the flow of fluid stops. In one embodiment, the strength of the biasing force on the valve head is variable.

In the embodiment with a quick connect coupling, it can be seen that fluid is retained in the feed tube and spray head when the apparatus is disconnected from the source of pressurized fluid or the control valve is closed. It can be seen that in the alternative embodiment having one nozzle at the end of a long tubular wand, there is a consistent delivery of fluid out of the nozzle when the control valve is actuated because the pressure and fluid volume in the tube is not lost through the nozzle when the control valve is closed. Accordingly, fluid will not sputter or spurt from the nozzle when the trigger is released after every painting stroke, for example, with this embodiment.

According to one aspect of the invention, a fluid spray apparatus is provided that has a spray head body having an intake port, an output port and a central channel, a nozzle head coupled to the spray head body in fluid communication with the output port, and a flow control valve, wherein the flow of fluid flowing from the intake port to the output port is stopped when the pressure of the flow of fluid drops below a threshold level.

According to another aspect of the invention a fluid flow stop valve is provided with a tubular valve body having an input port, a central chamber and output port, a valve seat disposed within the central chamber, and a biased valve head configured to engage the valve seat and stop a flow of fluid flowing from the intake port to the output port when the pressure of the flow of fluid drops below a threshold level and a means for adjusting the strength of the bias of the valve head.

According to another aspect of the invention, a fluid spray apparatus is provided with a manifold and a number of stop flow valves and nozzles. According to another aspect of the invention, a fluid spray apparatus is provided with a manifold, flow valves, nozzles and a handle with a flow control valve. In accordance with still another aspect of the invention, a spray apparatus is provided that has a manifold with stop flow valves and nozzles that is connected to tubing from a source of pressurized liquid and is configured to allow the manifold to swivel about the connection. According to another aspect of the invention, a spray apparatus is provided with a manifold, tubing and a quick connect coupling. According to another aspect of the invention, a spray apparatus is provided with a manifold, stop flow valves, nozzles, tubing, a quick connect coupling and a handle that is linearly offset from the manifold. According to another aspect of the invention, a spray apparatus is provided with a single flow valve and nozzle and a tube coupled to a source of pressurized fluid or a quick connect coupling.

An object of the invention is to provide a spray apparatus that allows for uniform fluid delivery through a nozzle without discharging excess fluid when the fluid pressure drops or that will leak during storage.

Another object of the invention is to provide an apparatus with a quick change coupling for easily interchanging spray heads after use.

Another object of the invention is to provide an apparatus for painting a large surface with a single pass of the paint spray system.

Another object of the invention is to provide a fluid nozzle in combination with a stop flow valve to prevent sputtering when the pressurized fluid source is closed.

Another object of the invention is to provide a stop flow valve that will stop the flow of fluid in a pressurized system when the source of pressure drops below a threshold level.

Another object of the invention is to provide an apparatus for painting a surface that minimizes the labor time expended by the painter.

Yet another object of the invention is to provide an apparatus for painting a surface that minimizes the amount of paint required.

Further objects, aspects and advantages of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWINGS

The invention will be more fully understood by reference to the following drawings, which are for illustrative purposes only.

DETAILED DESCRIPTION OF THE INVENTION

Referring more specifically to the drawings, for illustrative purposes the various embodiments of the present invention are generally shown in FIG. 1 through FIG. 18. It will be appreciated that the invention may vary as to configuration and as to details of the parts without departing from the basic concepts as disclosed herein.

Figure 1:
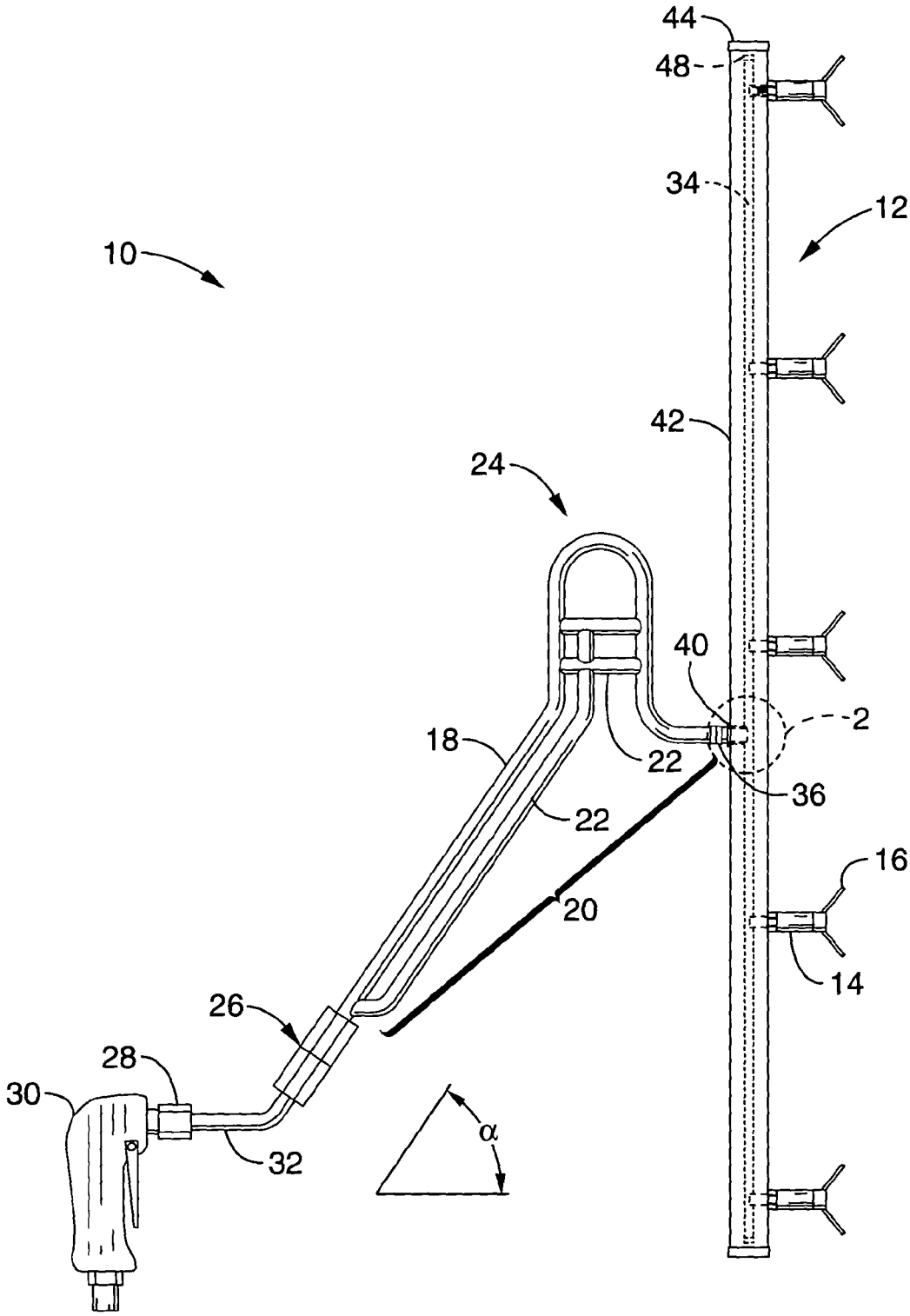
FIG. 1 is a side view of a multiple nozzle handheld paint spraying apparatus with anti-sputter stop flow valves according to the present invention.

Referring first to FIG. 1, an apparatus with multiple spray nozzle assemblies according to the present invention is generally shown. In the embodiment shown, the apparatus 10 generally comprises a spray head 12 shown in a vertical orientation and supporting a plurality of stop flow valves 14 and fluid spray nozzles 16. The details of stop flow valves 14, which are also referred to herein as anti-sputter valves, are shown in FIG. 3 through FIG. 7 and described below. While spray head 12 is shown in a vertical orientation for facilitating side-to-side spraying motions, it will be appreciated that spray head 12 could alternatively be configured in a horizontal or other orientation for up and down or angled spraying motions. Spray head 12 is configured to be coupled to a source of pressurized fluid, such as paint, by means of a handle assembly 20 that preferably comprises a rigid feed tube 18 that is supported by a support bar 22.

Note that feed tube 18 includes an arcuate portion 24, shown in FIG. 1 as a one-hundred-eighty degree bend that provides for ergonomic handling of spray head 12 in a vertical orientation. Other angles could be used as well, provided that handle assembly 20 is balanced in relation to spray head 12. In addition, note that feed tube 18 is shown to be offset at an angle $\alpha$ of approximately forty-five degrees relative to horizontal. The offset angle allows the user to actuate a flow control valve 30 with one hand and hold and direct the position of the apparatus with the other hand during use by grasping feed tube 18 or arcuate portion 24. The angle may be selected depending on the size or length of the spray head and the length of the feed tube. Larger spray head assemblies may have a greater angle and individual nozzles may require little or no angle.

Each stop flow valve 14 and associated spray nozzle 16 is fluidly connected to the source of pressurized fluid through feed tube 18 such that fluid flowing through feed tube 18 is able to pass through the stop flow valve 14 and spray nozzle 16 during use. In the embodiment shown in FIG. 1, the fluid flows from feed tube 18 through manifold tube 34 and out though stop flow valves 14 and spray nozzles 16. Accordingly, spray head 12 is shown in a manifold configuration for compactness and ease of construction. However, it will be appreciated that alternatively each stop flow valve 14 could be connected to an individual tube and the plurality of individual tubes would in turn be connected to feed tube 18.

Figure 8:
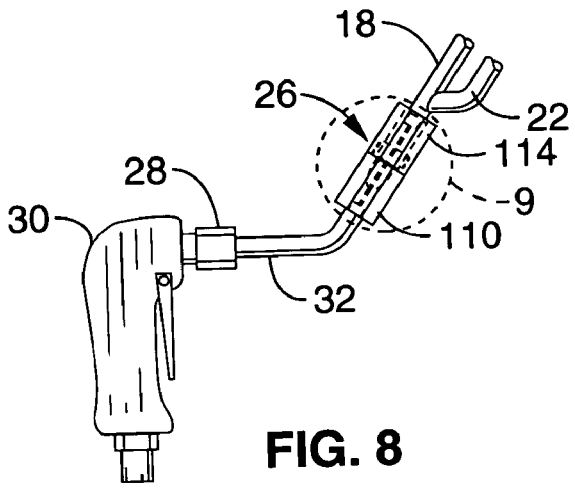
FIG. 8 is a side view of the handle and quick connect union portion of the apparatus according to the present invention shown in FIG. 1.
Figure 9:
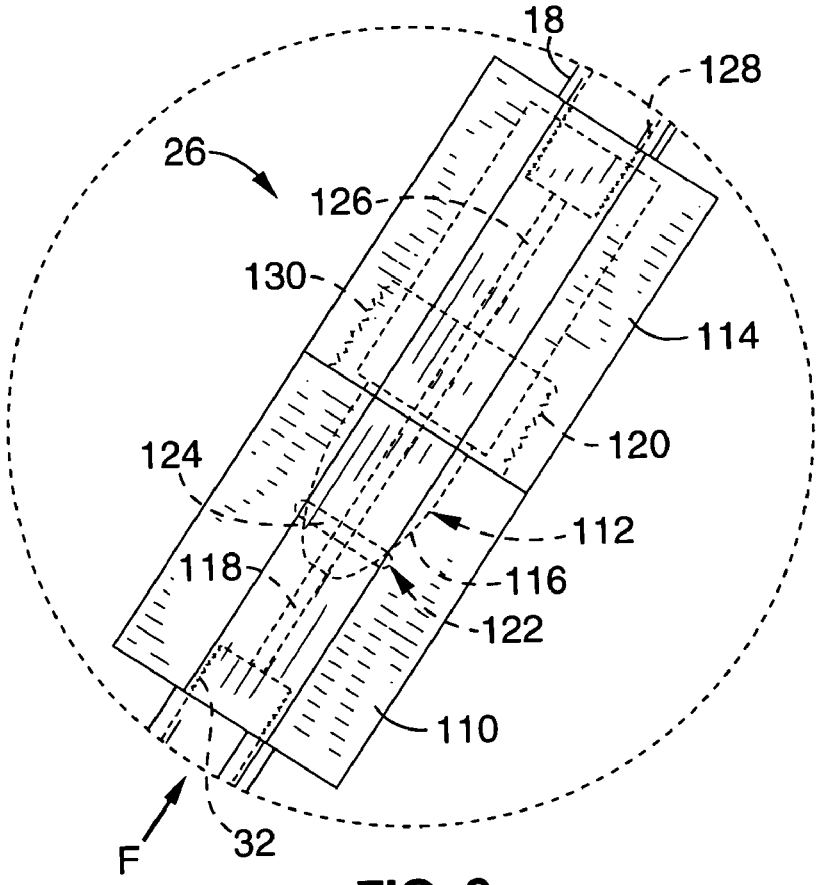
FIG. 9 is a detail view of an embodiment of the quick connect union shown in FIG. 8.
Figure 10:
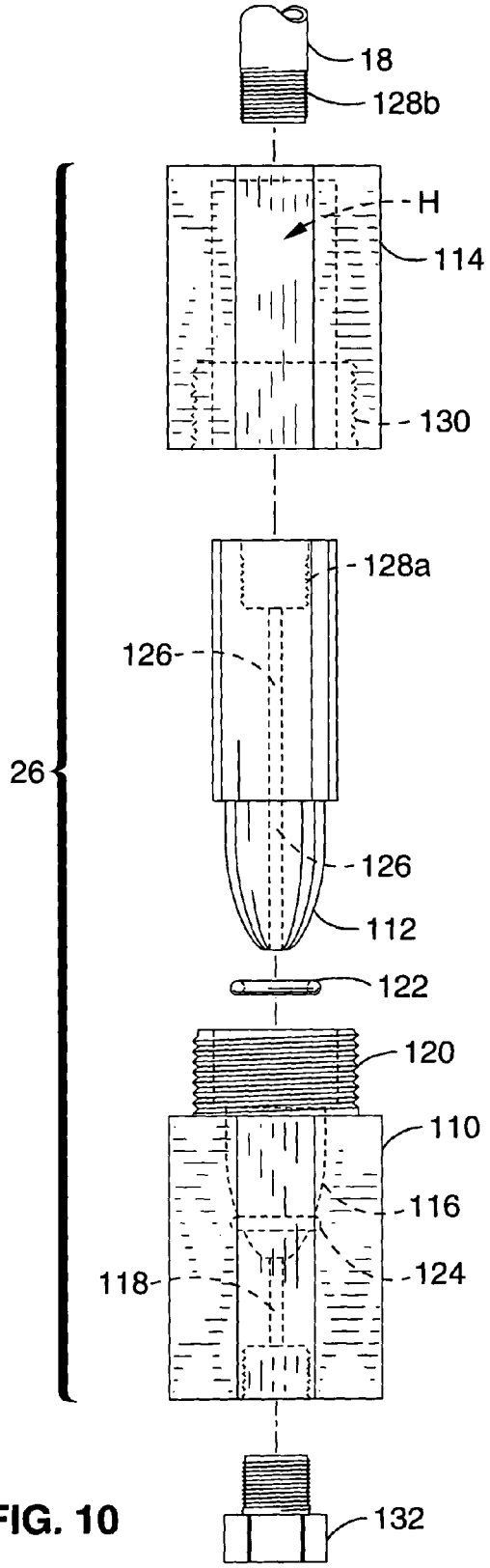
FIG. 10 is an exploded view of the quick connect joint shown in FIG. 9.

Feed tube 18 preferably includes a quick connect coupling 26 that allows for quick exchange of one spray head with another spray head that has a greater or fewer number of nozzles as desired. The details of quick connect coupling 26 are shown in FIG. 8 through FIG. 10 and described below. An adapter 28 can be used to connect feed tube 18 (through adapter tube 32 and quick connect coupling 26) to a conventional flow control valve 30, such as used with a pressurized paint gun, which can stop and start the flow of paint through the apparatus. It will be appreciated that flow control valve 30 can alternatively be placed in other locations such as near spray head 12 of the apparatus if desired.

Fluid supplied to the system may be pressurized by any of the commonly known methods for pressurizing fluids such as a pump or compressor (not shown) that is fluidly connected to a fluid supply, and is therefore not discussed in further detail. As seen in FIG. 1, pressurized fluids enter the apparatus through flow control valve 30, such as a conventional paint gun, that is preferably coupled to the apparatus by adapter coupling 28. The embodiments shown in FIG. 11 through FIG. 14 may be similarly connected to a fluid supply.

Flow control valve 30 regulates the flow of pressurized fluid from the fluid supply to the apparatus and out of spray nozzles 16. For example, the embodiment of the invention shown in FIG. 1 is configured for use with conventional compressors with a flow control valve that can be coupled with an entry port of the apparatus. For example, flow control valve 30 shown in FIG. 1 has a grip and trigger mechanism by which the user can initiate and stop the flow of fluid through the apparatus. However, it will be understood that flow control valve 30 can be positioned at any location along tubing 18 upstream from spray head 12 or spray nozzles 16.

It will be appreciated that the below threshold pressure and fluid volume in feed tube 18 will be maintained when the flow control valve 30 and the stop flow valves 14 are closed. When the apparatus is decoupled from the paint supply through the quick connect coupling 26, the fluid in the feed tube can be maintained by placing a plug in the open end of the supply side of the feed tube 18. Accordingly, fluid will not leak from the feed tube 18 or spray head 12 during transportation or short-term storage of the apparatus 10.

Figure 2:
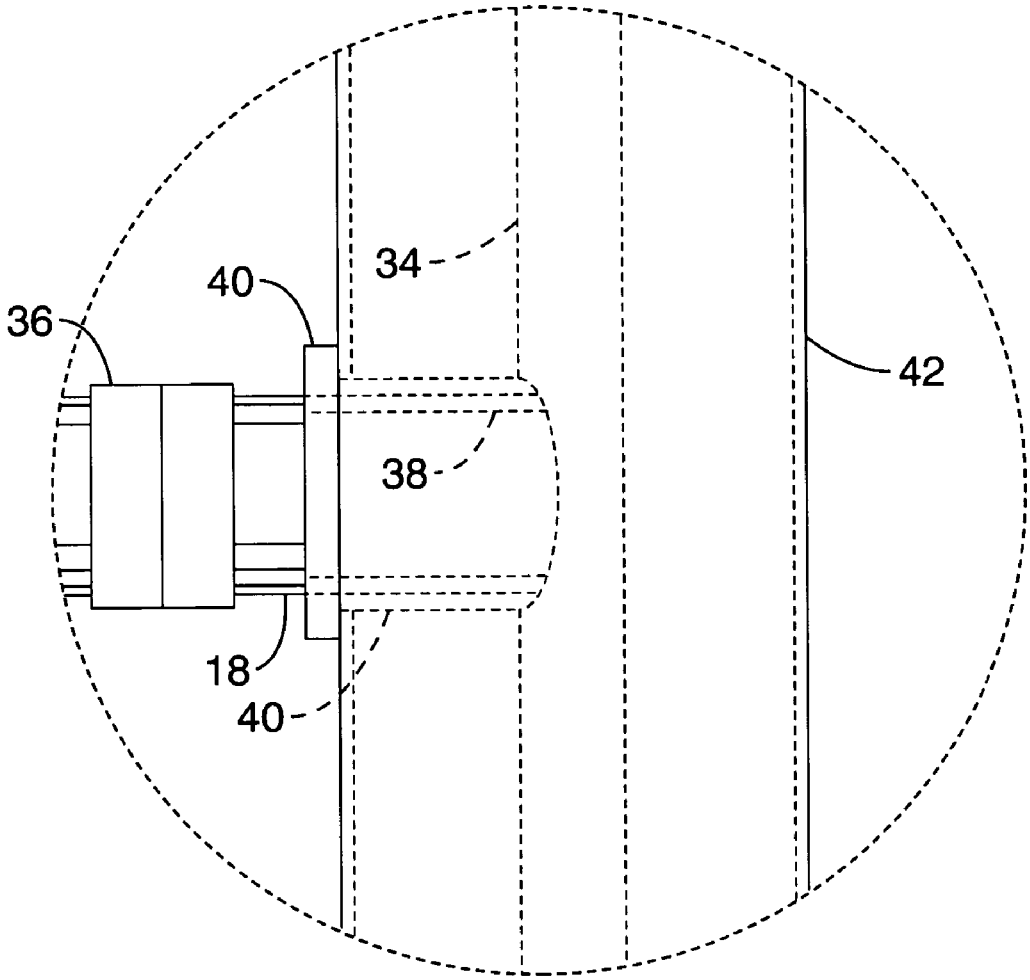
FIG. 2 is a detail of a handle assembly connection to a spray head with an alternative swivel joint as shown in FIG. 1.

In one embodiment, shown in FIG. 1 and FIG. 2, feed tube 18 is joined to spray head 12 with an optional swivel joint 36 that allows the spray head 12 to swivel axially around the joint. In this way, the user can adjust the relative position of handle assembly 20 and spray head 12 and nozzles 16.

In the embodiment shown, spray head 12 includes a manifold tube 34 that is in fluid communication with feed tube 18 and serves as a feeder of fluid to nozzles 16, and manifold tube 34 is positioned within a spray head support tube or manifold 42. FIG. 2 shows the details of a preferred connection of feed tube 18 to manifold tube 34 and manifold 42. In the embodiment shown, feed tube 18 is connected to manifold tube 34 by welding or the like. A reinforcing collar 40 is in turn connected to feed tube 18 and to manifold 42 by welding or the like. As a result, reinforcing collar 40 extends over a short stub portion 38 of feed tube 18 and provides a rigid connection between feed tube 18 and manifold 42. In this way, reinforcing collar 40 relieves stress at the connection point between feed tube 18 and manifold 42. Another reason for using collar 40 is for ease of construction. Since manifold tube 34 is positioned inside manifold 42, during construction it would not generally be feasible to weld feed tube 18 to manifold tube 34 and then weld feed tube 18 directly to manifold 42. Accordingly, construction would typically proceed as follows. A hole would be made in manifold 42 large enough to allow access to the connection point where feed tube 18 is to be welded to manifold tube 34. Reinforcing collar 40 would then be slipped over the end of feed tube 18 and slid back far enough to be out of the way. In FIG. 2, the swivel 36 (which is optional) is shown too close to manifold 42 of visually realize the distance at which reinforcing collar 40 would be slid back, but one can easily envision this if swivel 36 is eliminated. Next, the weld between feed tube 18 and manifold tube 34 would be made through the opening in manifold 42. Once that weld is made, reinforcing collar 40 would be slid back into its final position, with its head abutted against manifold 42 and its sleeve portion surrounding the stub portion 38 of feed tube 18. It will be appreciated that this same configuration could be realized when a swivel 36 is used by employing a two section feed tube 18, one section of which would comprise an elongated stub portion 38. The components forming swivel 36 would then be installed after the elongated stub portion is connected to manifold tube 34 and manifold 42. Alternatively, feed tube 18 could be threaded into a corresponding threaded receptacle in manifold tube 34 or manifold 42.

It can be seen in FIG. 1, that spray head 12 can be sized to receive multiple stop flow valves 14 and spray nozzles 16 that are preferably attached to spray head 12 linearly at evenly spaced intervals and configured to spray perpendicularly to spray head 12. Single nozzle spray heads and multiple nozzle spray heads can be quickly and easily exchanged with the quick connect coupling 26.

Figure 3:
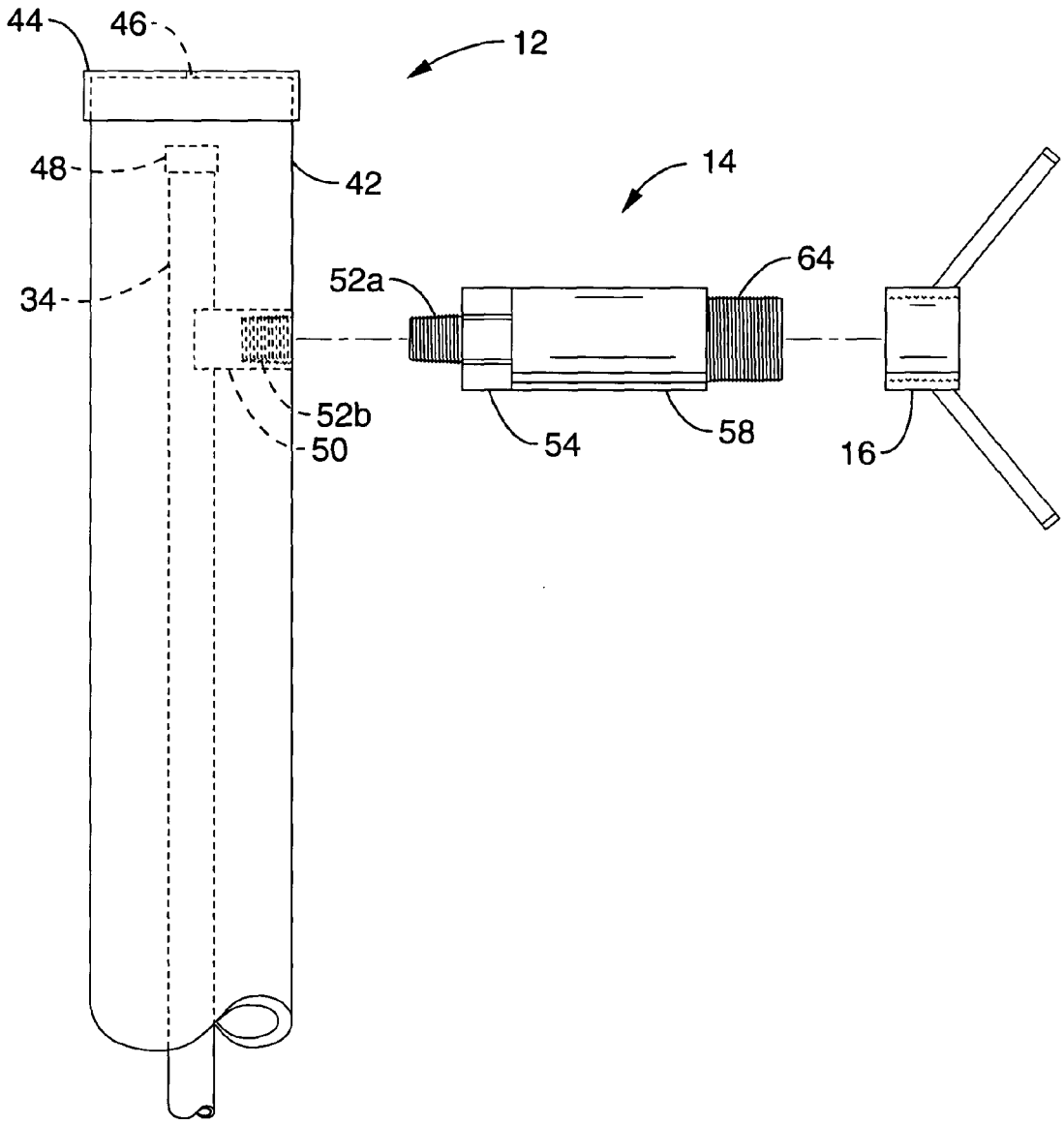
FIG. 3 is a detail of a spray head, a stop flow valve and a nozzle connection as shown in FIG. 1.
Figure 4:
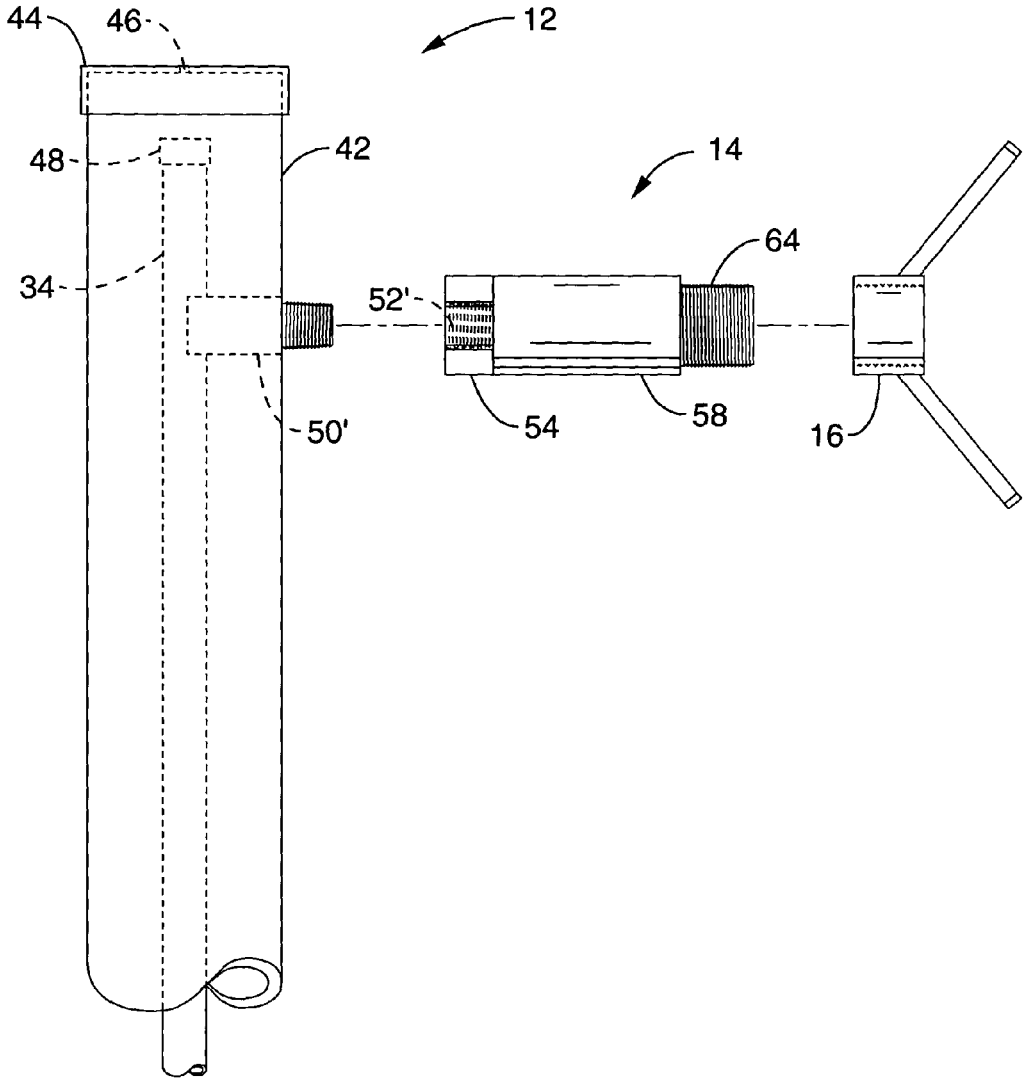
FIG. 4 is an alternative embodiment of a stop flow valve adapted to connect as shown in FIG. 3.

Referring also to FIG. 1, FIG. 3 and FIG. 4, manifold 42 is shown closed at each end with a cap 44 containing a vent hole 46 and manifold tube 34 is preferably closed at each end with a cap 48. Pressurized fluid is provided to the spray head 12 as described previously through manifold tube 34 and through output tubes 50 to stop flow valves 14 and spray nozzles 16. Stop flow valves 14 are provided to prevent fluid from spurting out from the associated spray nozzles 16 immediately after flow control valve 30 is shut off. During use, fluid is under pressure within tubes 18, 32 and 34. Without stop flow valves 14, pressurized fluid would spurt or sputter from spray nozzles 16 after flow control valve 30 has been shut off due to the residual pressure in tubes 18, 32 and 34 forcing fluid through the spray nozzles 16 as the pressure dissipates. In addition, fluid would leak from the apparatus during transportation without flow control valve 30 and preferably quick connect coupling 26 with an optional plug. In this embodiment, fluid remains in the tubular network of the apparatus during transportation or storage unless the fluid is released for cleaning.

Referring to FIG. 3 through FIG. 7, each stop flow valve 14 preferably comprises a threaded fitting with an inlet end 54, an inlet port 56, an output end 58, and an output port 60. Note from FIG. 3 and FIG. 4 that two embodiments of the interface between stop flow valves 14, manifold tube 34, and manifold 42 are shown. In the embodiment shown in FIG. 3, inlet end 54 of stop flow valve 14 is configured with a threaded male fitting 52*a* which can be quickly coupled with a threaded female socket 52*b* in output tube 50 by screwing the parts together. In the embodiment shown in FIG. 4, the inlet end 54 is configured with a threaded female fitting 62*a* adapted to receive a corresponding threaded male fitting 62*b* on output tube 50.

Figure 5A:
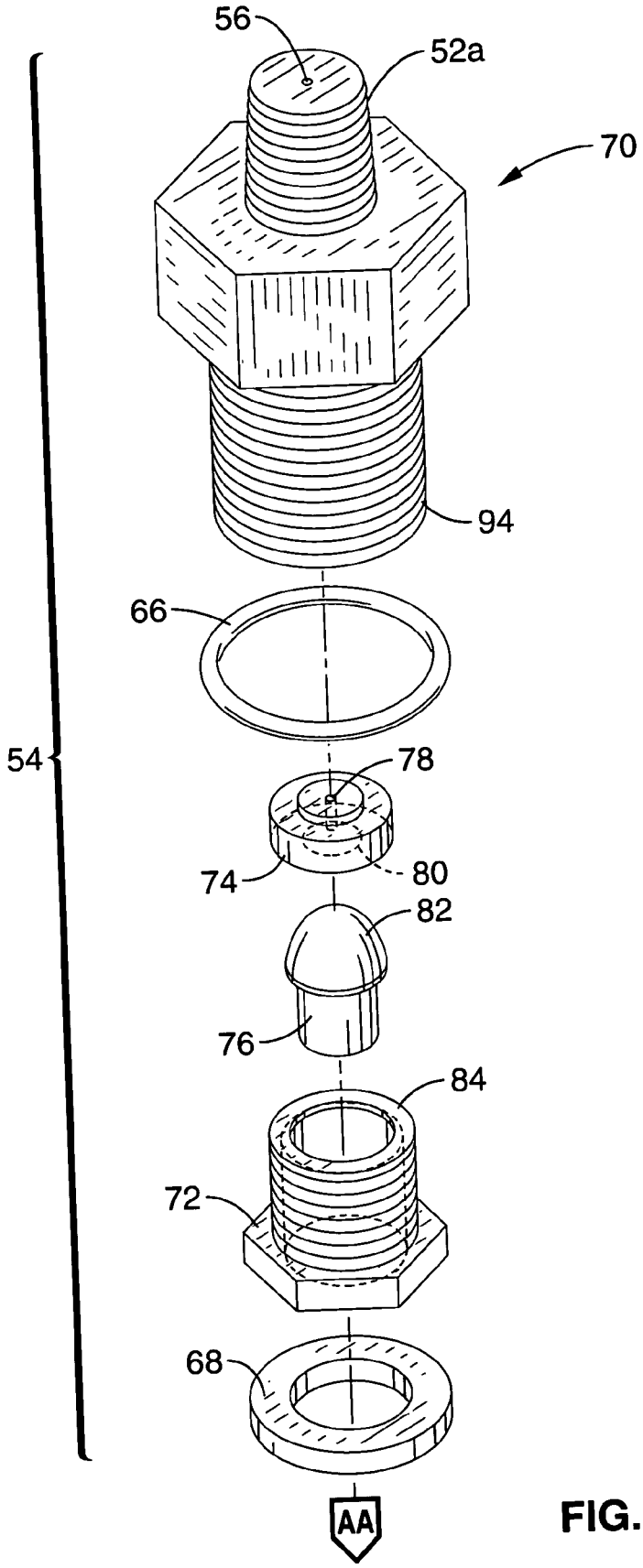
FIG. 5A is an exploded perspective view of the inlet section of the stop flow valve shown in FIG. 3.
Figure 5B:
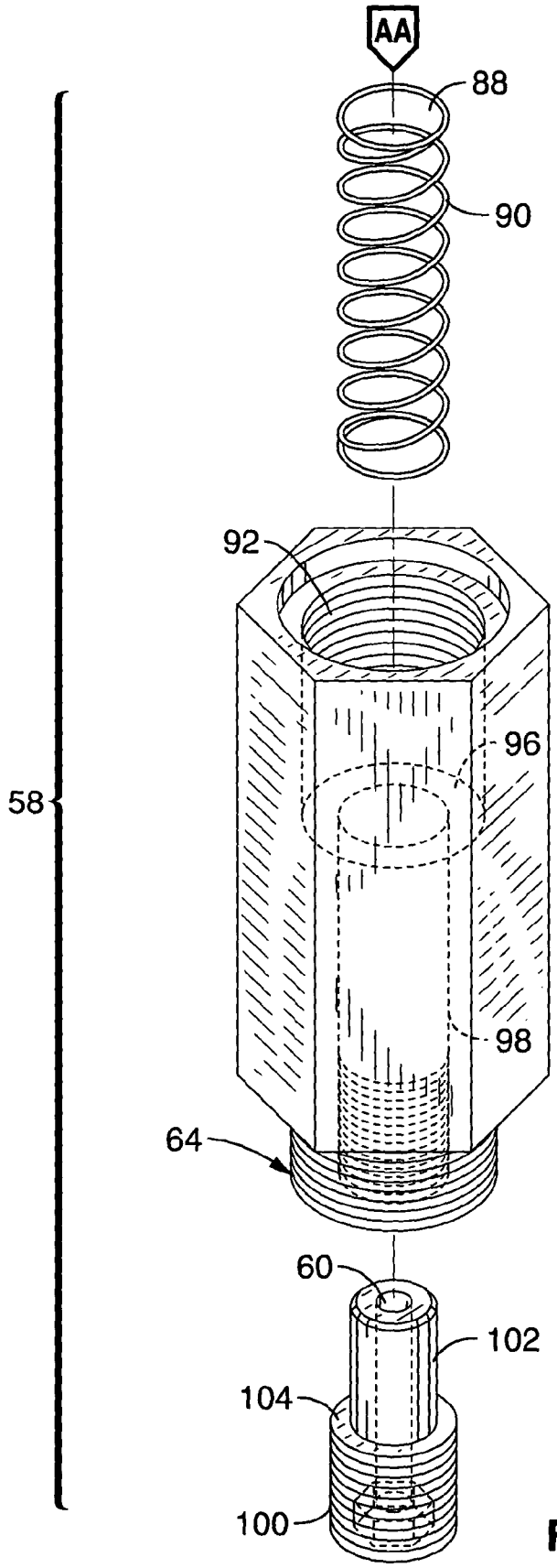
FIG. 5B is an exploded perspective view of the output section of the stop flow valve shown in FIG. 3.
Figure 6:
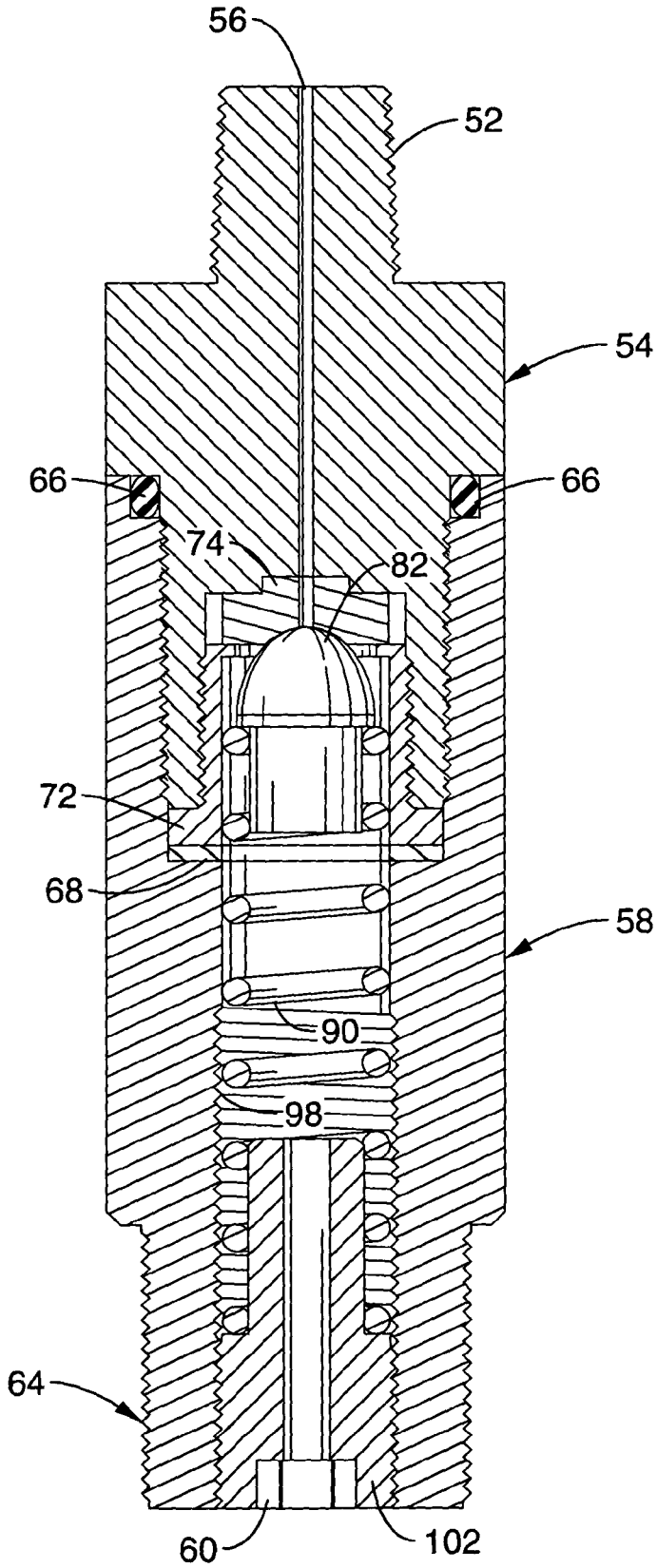
FIG. 6 is a cross-sectional view of the stop flow valve shown in FIG. 4 with the valve in the closed position.
Figure 7:
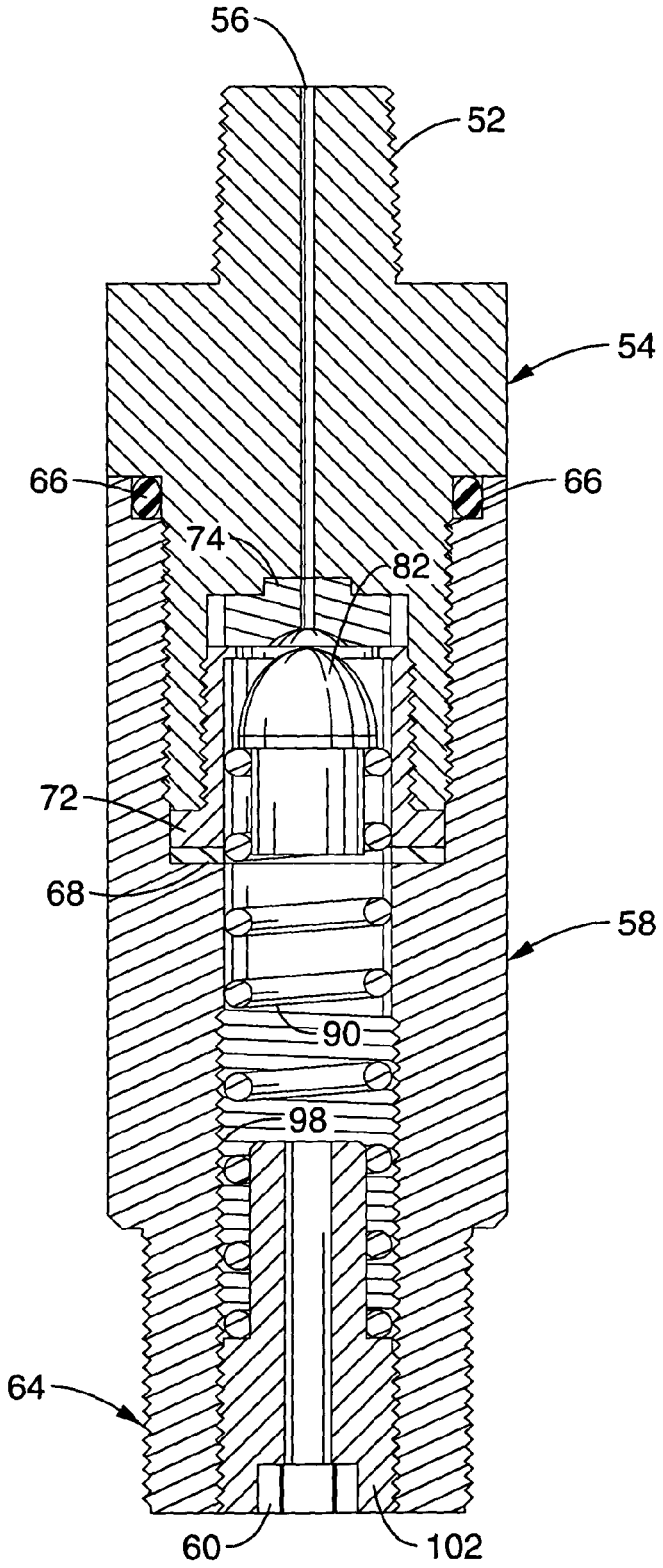
FIG. 7 is a cross-sectional view of the stop flow valve shown in FIG. 4 with the valve in the open position.

Referring to the embodiment shown in FIG. 3, inlet section 54 and output section 58 are preferably threadably coupled together as shown in FIG. 5 through FIG. 7 by seating and sealing the two components with an O-ring 66 and a disk 68 made of Teflon®, rubber, plastic or other material capable of sealing the coupled sections. The embodiment shown in FIG. 4 would be assembled in the same manner.

Referring now more specifically to FIG. 5A an exploded view of the preferred embodiment of inlet section 54 corresponding to the embodiment of FIG. 3 is shown. In this embodiment, Inlet section 54 includes a hollow inlet body 70 that carries male fitting 52*a* with inlet port 56. The opposite end of inlet body 70 carries exterior threads 94, as well as interior threads (not shown) that are adapted to receive a threaded tubular seat retainer 72. Inlet section 54 also has a valve seat 74 and a corresponding valve head 76. Referring also to FIG. 6 and FIG. 7, in the embodiment shown valve seat 74 is provided with a flange that fits within a milled section at the center of the inlet body 70 such that the bore 78 at the center of valve seat 74 is aligned with inlet port 56. In an alternative embodiment, valve seat 74 is milled directly in the center of inlet body 70 and inlet port 56. Valve seat 74 preferably has a seat face 80 that has the same dimensions as the engaging surface of the valve head 82 so that a seal is created and the movement of fluid in inlet port 56 in either direction is stopped. During assembly, valve seat 74 is positioned interior to inlet body 70 and seat retainer 72 is advanced on the interior threads of inlet body 70 until the distal rim 84 of the retainer 72 secures the seat in the inlet body 70.

FIG. 5B shows the output section 58 of stop flow valve 14. Output section 58 includes a linear spring 90 that tensions valve head 82. Valve head 82 preferably has a cylindrical body 76 that is sized to fit within the center 88 of one end of linear spring 90 as shown in FIG. 6 and FIG. 7. Spring 90 and valve head 82 can fit within the center of retainer 72 so that valve head 82 can seat against face 80 of seat 74 during use.

The output section 58 is preferably tubular with two sets of internal threads and one set of exterior threads. The first set of internal threads 92 receives the exterior threads 94 of inlet section 54 of stop flow valve 14. Disk 68 is seated on a flange 96 at the base of the interior threads 92 such that the outside edge of retainer 72 engages the disk when the inlet section 54 and the output section 58 are coupled together. In addition, O-Ring 66 seals the upper joint between inlet section 54 and outlet section 58.

The second set of internal threads 98 of the output section 58 of stop flow valve 14 are configured to receive the exterior threads 100 of nozzle outlet member 102 that includes output port 60. The end of linear spring 90 opposite head 82 preferably fits over the end of outlet member 102 and engages flange 104. It can be seen that movement of outlet member 102 increases or decreases the compression of spring 90 and the pressure exerted upon the valve head 82 against face 80 of valve seat 74. The outer end of output port 60 is preferably configured to accommodate a hexagonal wrench or other tool to allow the nozzle outlet member 102 to be easily inserted or removed from the body of output section 58.

When assembled, stop flow valve 14 is normally in the closed position as shown in FIG. 6. In the closed position, valve head 82 is fully engaged with valve seat 74 so that inlet port 56 is closed. When the pressure of the fluid in inlet port 56 exceeds the force exerted by the spring 90 on valve head 82, the valve head 82 will retract away from the valve seat 74 and the fluid will enter the interior of output section 58 of stop flow valve 14 and out of the output port 60 as shown in FIG. 7. When the force created by the pressure of the fluid in inlet port 56 on valve head 82 drops below the force exerted by spring 90 on head 82, the valve head 82 will engage valve seat 74 and shut off the flow of fluid from the inlet port 56 to the output port 60. Thus, when flow control valve 30 is shut off, spring 90 instantaneously biases valve head 82 back against the valve seat 74, thus shutting off the flow of fluid and prohibiting fluid from spurting out of nozzles 16.

It can be seen that the threshold level of the opening of stop flow valve 14 can be varied. Increasing the compression of biasing spring 90 by advancing outlet member 102 along internal threads 98 of output section 58 will increase the pressure of the fluid in inlet port 56 necessary to move valve head 82 and open the valve. Likewise, decreasing the compression of spring 90 will reduce the pressure of the fluid in inlet port 56 that is necessary to open the valve. The pressure in the entire system can be released by removing nozzle outlet member 102, spring 90 and valve head 82.

It is preferred that the volume of the flow of fluid through output port 60 be approximately the same volume as the flow of fluid through inlet port 56. However, it will be understood that the diameter of inlet port 50 and output port 56 can be different depending on the desired volume of fluid flow and threshold fluid pressures.

Referring now to FIG. 8 through FIG. 10, additional details of quick connect coupling 26 are generally shown. Quick connect coupling 26 allows the user to exchange spray heads that have different numbers of spray nozzles quickly and efficiently. For example, an embodiment with four or five nozzles may be used to paint an interior wall or large sections of exterior surfaces with one pass. Thereafter, the user may desire to exchange the large multiple nozzle spray head for a spray head with one or two nozzles that can be used to paint smaller surfaces, corners or areas that require additional paint.

Referring more specifically to FIG. 9 and FIG. 10, one embodiment of quick connect coupling 26 is shown. Quick connect coupling 26 has a base portion 110, a seal member 112 and a coupling collar 114. Base 110 is preferably coupled to input tube 32, which in turn is joined to flow control valve 30 by adapter coupling 28 as shown in FIG. 1. Base 110 has a seat 116 adapted to mate with seal member 112, an axial bore 118 and external threads 120 at the proximal end. Seal member 112 and seat 116 preferably have a frustoconical shape. Optionally, the frustoconical shaped seat 116 has an O-ring 122 that fits in a circumferential groove 124 to provide additional sealing capability.

Seal member 112 is preferably sized and shaped to mate with seat 116 so that there is a tight fit when the seal 112 and seat 116 engage. Seal 112 also has an axial bore 126 that is preferably aligned with the axial bore 118 of base 110. Furthermore, seal 112 preferably includes a set of internal female threads **128*a* at the opposite end that mate with external male threads 128*b* on feed tube 18 as shown, or the thread configuration can be reversed. In this way, seal 112 is attached to feed tube 18 and the distal end of feed tube 18 is fluidly coupled with the axial bore 126 of seal 112. Collar 114 has a central hole H that is sized to receive the end of feed tube 18 and is capable of sliding up and down the lower end of feed tube 18 and can enclose all or part of seal 112 when it is coupled to base 110. Collar 114 has internal female threads 130 that are configured to engage male threads 120 of base 110. When threads 130 are advanced on threads 120 of base 110, the collar 114 directs seal 112 to seat 116 and causes seal 112 to fully engage seat 116 and thereby seal the joint. Optionally, an O-ring 122 is disposed in seat 124 of base 110 to provide additional sealing capability to quick connect coupling 26**.

Quick connect coupling 26 can be disconnected by withdrawing threads 130 of collar 114 by rotating collar 114 axially about feed tube 18. Base 110 will then be available to receive similarly configured seal and collar pieces from a second feed tube and spray head as described herein. Quick connect coupling can also be disconnected by withdrawing threads of adapter tube 32 from corresponding threads in base 110 if the two components are threadably coupled as shown in FIG. 19. A threaded plug 132 can be provided and inserted into base 110 to prevent fluid leakage. The flow of fluid through quick connect coupling 26 is indicated by the letter "F" in FIG. 9.

Figure 11:
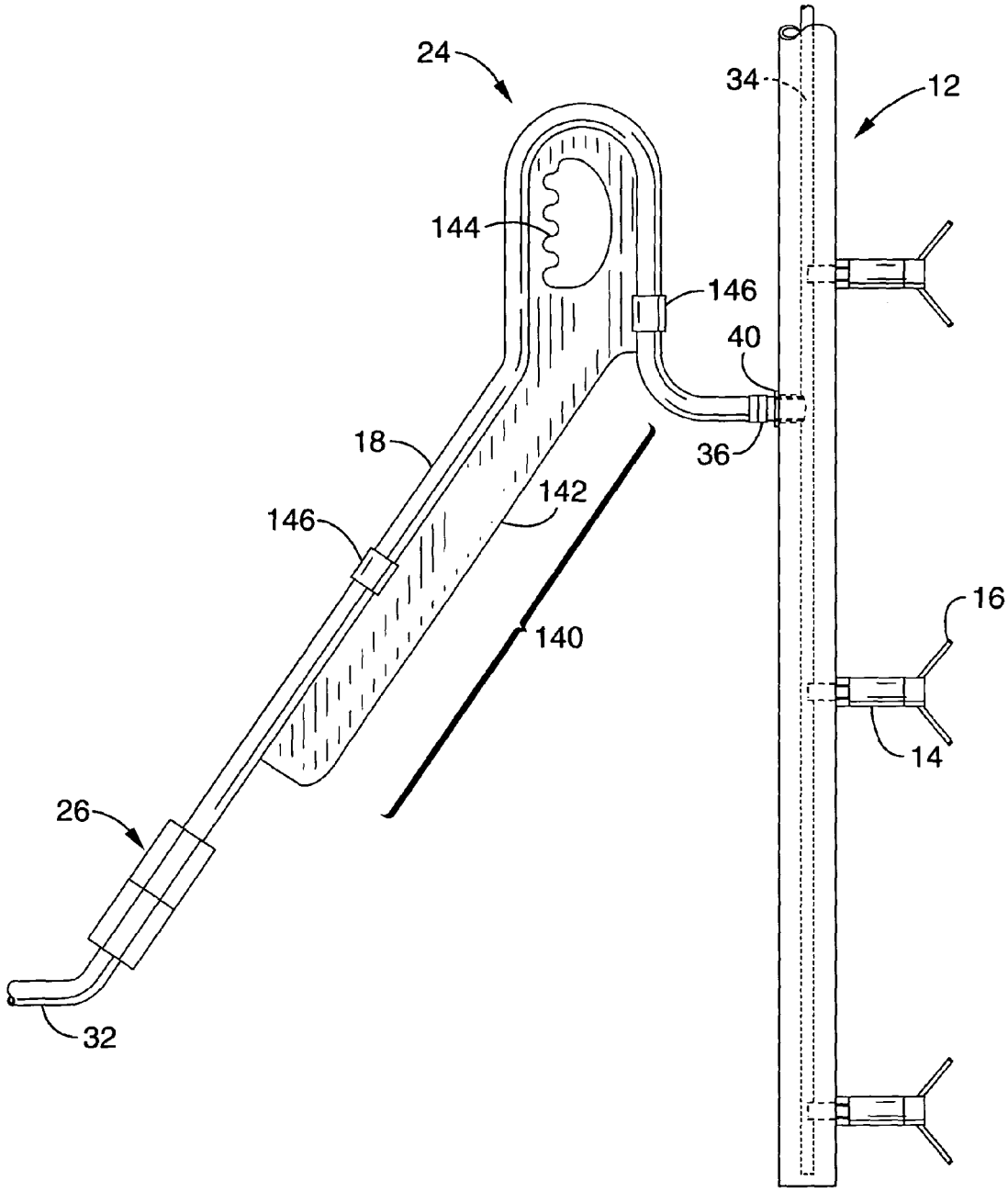
FIG. 11 is an alternative embodiment of a handle assembly reinforcement as shown in FIG. 1.

Referring now to FIG. 11, an alternative embodiment of a handle assembly 140 with reinforcement handle 142 is shown. Reinforcement handle 142 has a molded handle opening 144 for positioning the apparatus and is molded to fit feed tube 18 with concave surfaces and attach to feed tube 18 with split clamps 146.

Figure 12:
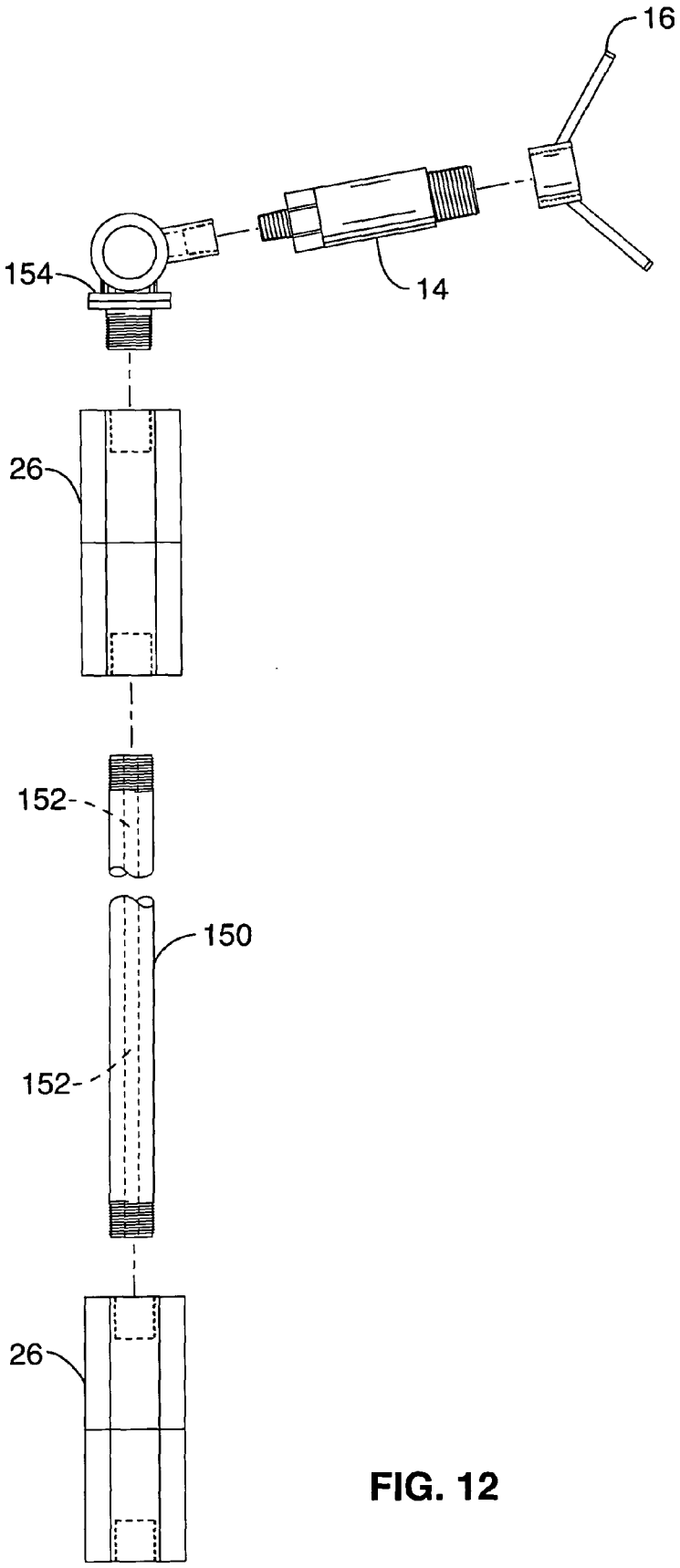
FIG. 12 is a wand assembly as an alternative embodiment of a handle assembly according to the present invention as shown in FIG. 1.

FIG. 12 shows an alternative embodiment of the invention with a single stop flow valve 14 and spray nozzle 16 disposed at the end of a tubular wand 150 having a central bore or inner lumen 152 at the center. Wands with one or more nozzles may be used for painting vaulted and other high ceilings and surfaces that are difficult for the painter to gain access to for painting. Pressurized fluid flows through central bore 152 and ultimately out through spray nozzle 16.

Central bore 152 of wand 150 can be sized at various diameters to provide a wide range of fluid disbursement volumes and pressures. Wand 150 can also be of varying lengths to enable the user, for example, to apply paint on surfaces that are not readily accessible with the use of ladders, scaffolding or the like. A swivel coupling 154 with a fluid channel running therethrough may optionally be coupled to wand 150 with a quick connect coupling 26 for connection to a single stop valve 14 and nozzle 16 to allow for angular positioning of the spray nozzle. The wand 150 may be connected with a second quick connect coupling 26 to connect to a pressurized paint supply so that the apparatus can be quickly removed from a source of pressurized fluid and a different spray head attached to the source of pressurized fluid and flow control valve 30.

Figure 13:
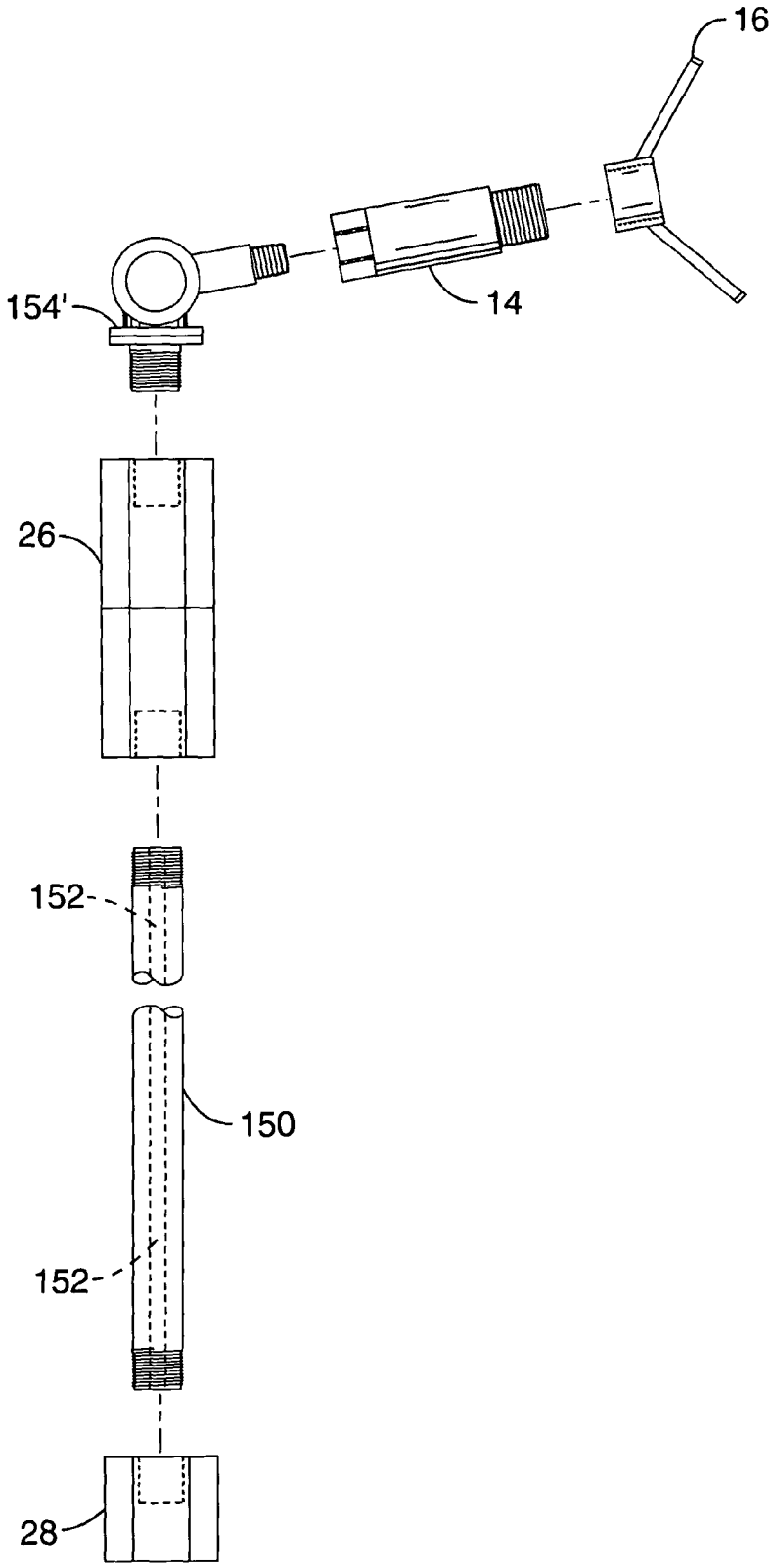
FIG. 13 is an alternative embodiment of the wand assembly as shown in FIG. 12.

FIG. 13 shows an alternative embodiment of the configuration shown in FIG. 12 where wand 150 is configured for direct coupling to a pressurized paint supply through adapter coupling 28 instead of using a quick connect coupling 26. FIG. 13 also illustrates an alternative embodiment of stop flow valve 14 as shown in FIG. 4 adapted to attach to a male fitting on swivel coupling 154.

Figure 14:
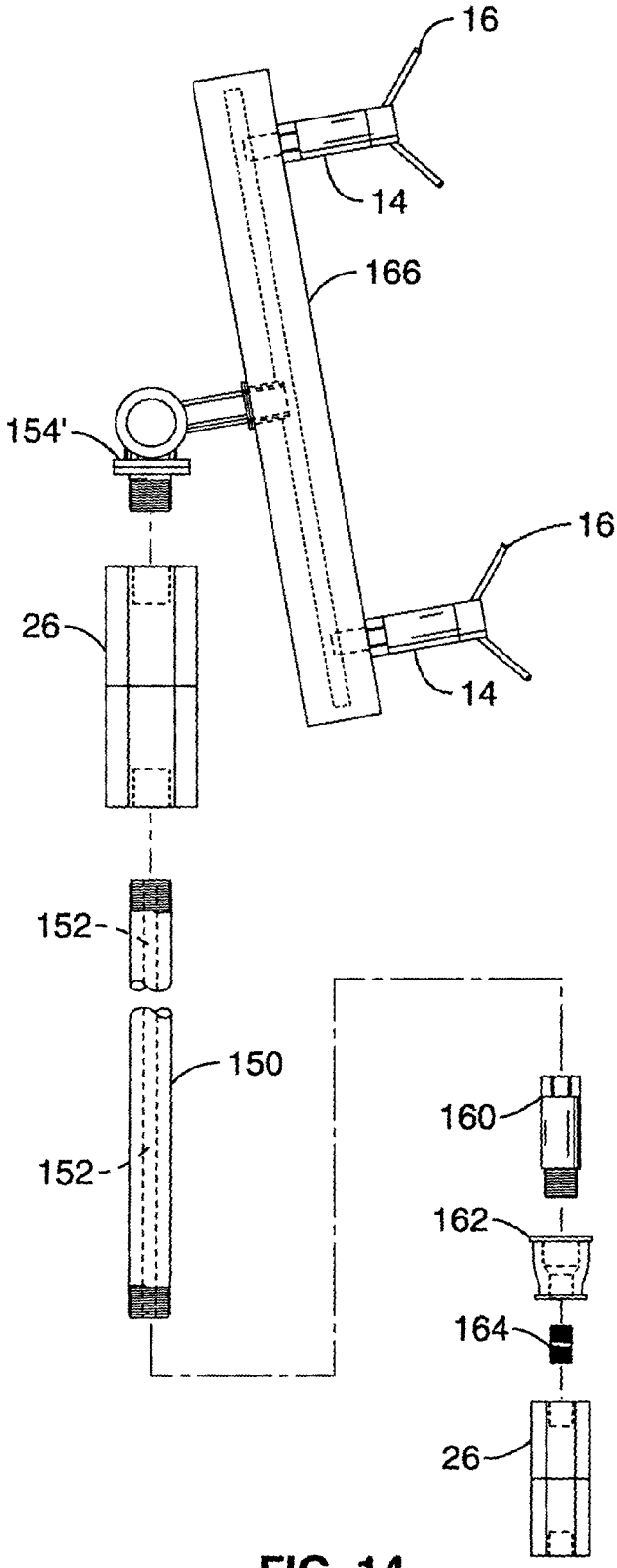
FIG. 14 is an alternative spray head attached to a wand assembly as shown in FIG. 12 and an alternative deployment of a stop flow valve.

FIG. 14 shows a further alternative embodiment where a second stop flow valve 160 is coupled between the coupling end of wand 150 with reducer 162 and nipple 164 and a quick connect coupling 26 so that pressure is maintained in the center bore 152 of wand 150 when the wand is detached with quick connect coupling 26. In this embodiment, less pressure and fluid volume is required to actuate the stop flow valve 14 to spray because of the residual pressure that is maintained in the wand. A two port spray head 166 supports two stop flow valves 14 and is coupled to a swivel coupling 154.

Figure 15:
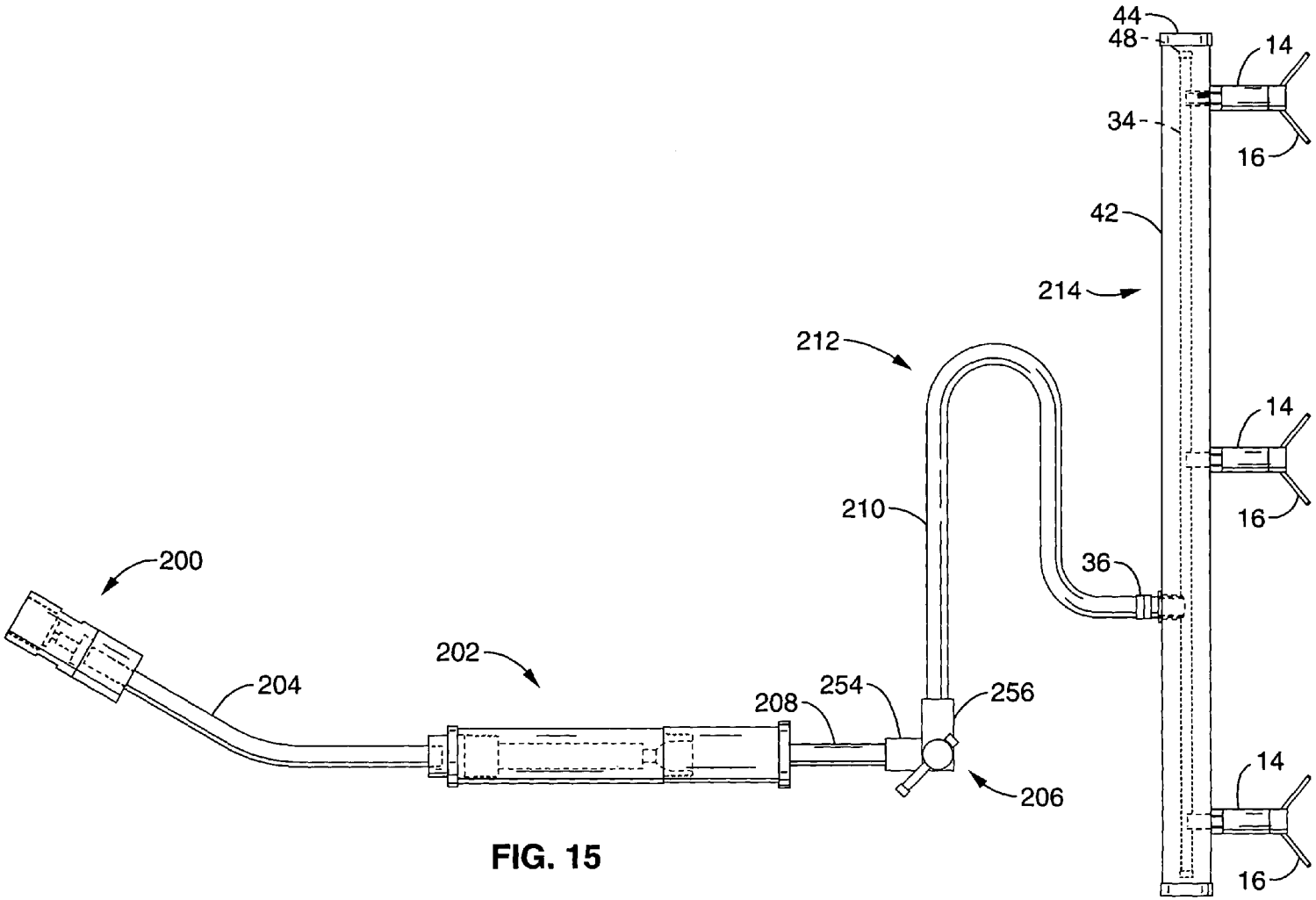
FIG. 15 is an assembled view of an alternative embodiment of the invention employing a swivel coupling, a filter assembly, and a spray head angle swivel mechanism.

Referring now to FIG. 15, an embodiment of the invention is shown that exhibits additional features and modes of operation. For example, comparing this embodiment to the embodiment shown in FIG. 1, a line swivel 200 is used instead of a quick connect coupling 26 as shown in FIG. 1. Note that the adapter 28, flow control valve 20, and adapter tube 32 shown in FIG. 1 are not shown in FIG. 15 but would be connected to line swivel 200 in a similar manner as they would be connected to quick connect coupling 26. Note also that the supply connection to line swivel 200 can be implemented in other ways as well, and this embodiment is not limited to the particular supply connection configuration shown in FIG. 1. An optional inline filter assembly 202 is connected to line swivel 200 through a section of feed tubing 204. Further, a spray head angle swivel 206 is connected to filter assembly 202 through a section of feed tubing 208. Another section of feed tubing 210, having an arcuate section 212 similar to arcuate section 24, is coupled to a spray head 214 in the manner previously described. In the embodiment shown, the spray head comprises a three port spray head, but spray heads with fewer or greater spray nozzles also could be used as previously described.

As can be seen, there are several beneficial features of this embodiment.

First, line swivel 200 allows for pivotal movement of the spray head in relation to the supply source (e.g., flow control valve 20). As a result, the user can easily hold flow control valve 20 in one hand, and rotate the spray head 214 between horizontal and vertical orientations to accommodate spraying in different positions by, for example, rotating arcuate 212 portion of feed tubing 210. This feature is particularly useful when changing from spraying ceilings to spraying walls. In addition, when spraying walls, the user can easily adjust the spray head when spraying high versus low wall areas. Furthermore, line swivel 200 can be used as an alternative to optional swivel joint 26 or in combination therewith.

Additionally, filter assembly 202 is provided to remove small particulates or contaminants from the paint which could potentially clog the spray nozzles or stop flow valves.

Furthermore, note that the combination of feed tubing 208 and feed tubing 210 (and filter assembly 202 if used) form a handle assembly with an offset angle in relation to the longitudinal axis running through manifold 42. More particularly, the offset angle of feed tubing 208 (and filter assembly 202 if used) in relation to manifold 42 serves same purpose and function as previously described in relation to the handle (feed tube) configurations shown in FIG. 1 and FIG. 11. However, instead of fixing the offset angle as shown in FIG. 1 and FIG. 11, spray head swivel 206 allows the offset angle to be adjusted. This feature is particularly useful for accommodating users of different heights. Spray head swivel 206 allows the user to "customize" the offset angle of the spray head in relation to the feed tubing/handle assembly so that the user can comfortably, for example, actuate flow control valve 30 with one hand and hold and direct the position of the apparatus with the other hand during use by grasping arcuate portion 212 of feed tubing 210 or filter assembly 202. It can be seen that in this embodiment the spray head offset angle may be selected depending on, for example, the size or length of the spray head, the length of the sections of feed tubing and overall length of the assembly, the height of the user, and/or the general comfort of the user.

Figure 16:
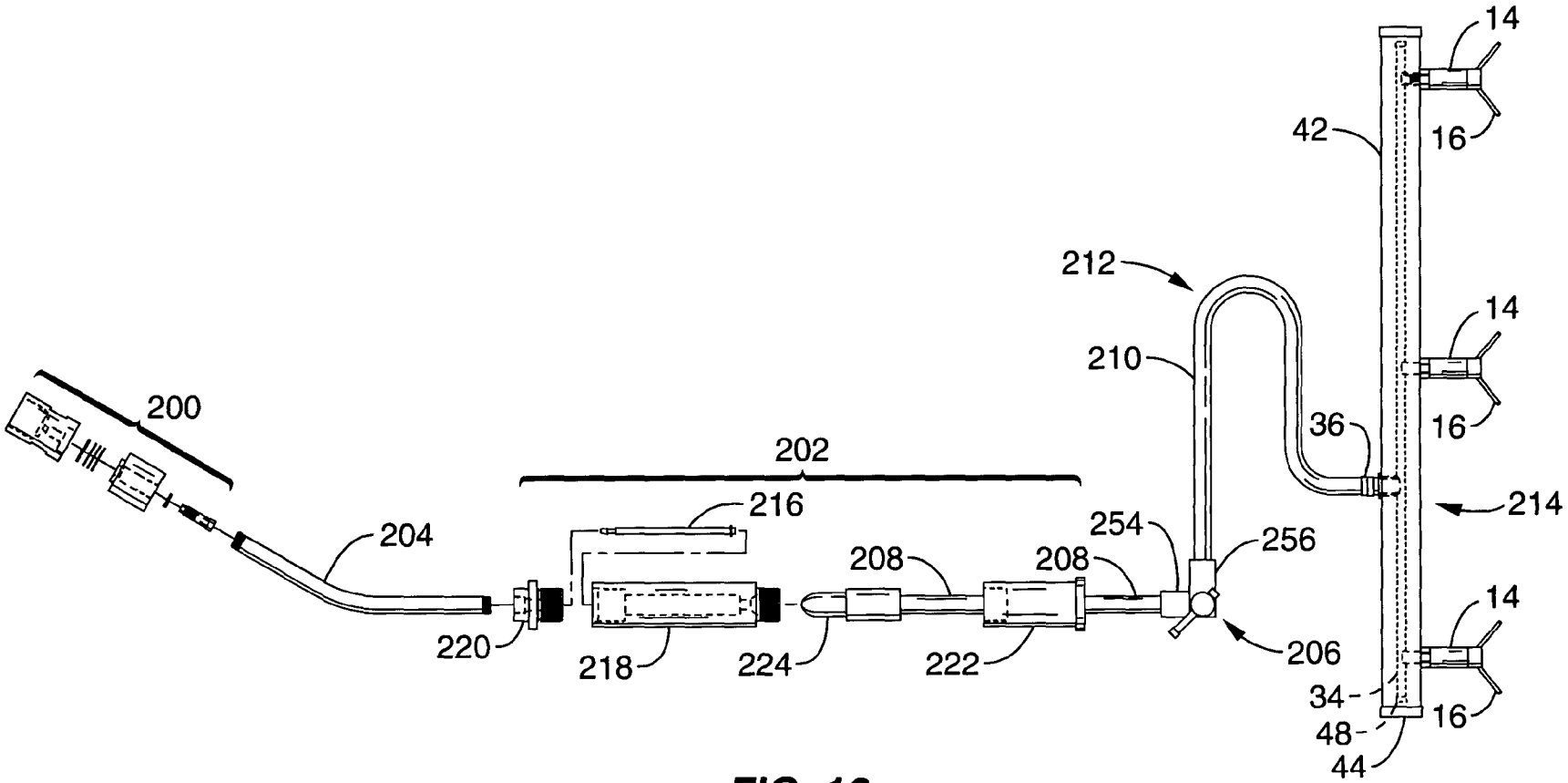
FIG. 16 is a partial exploded view of the assembly of FIG. 15.
Figure 17A:
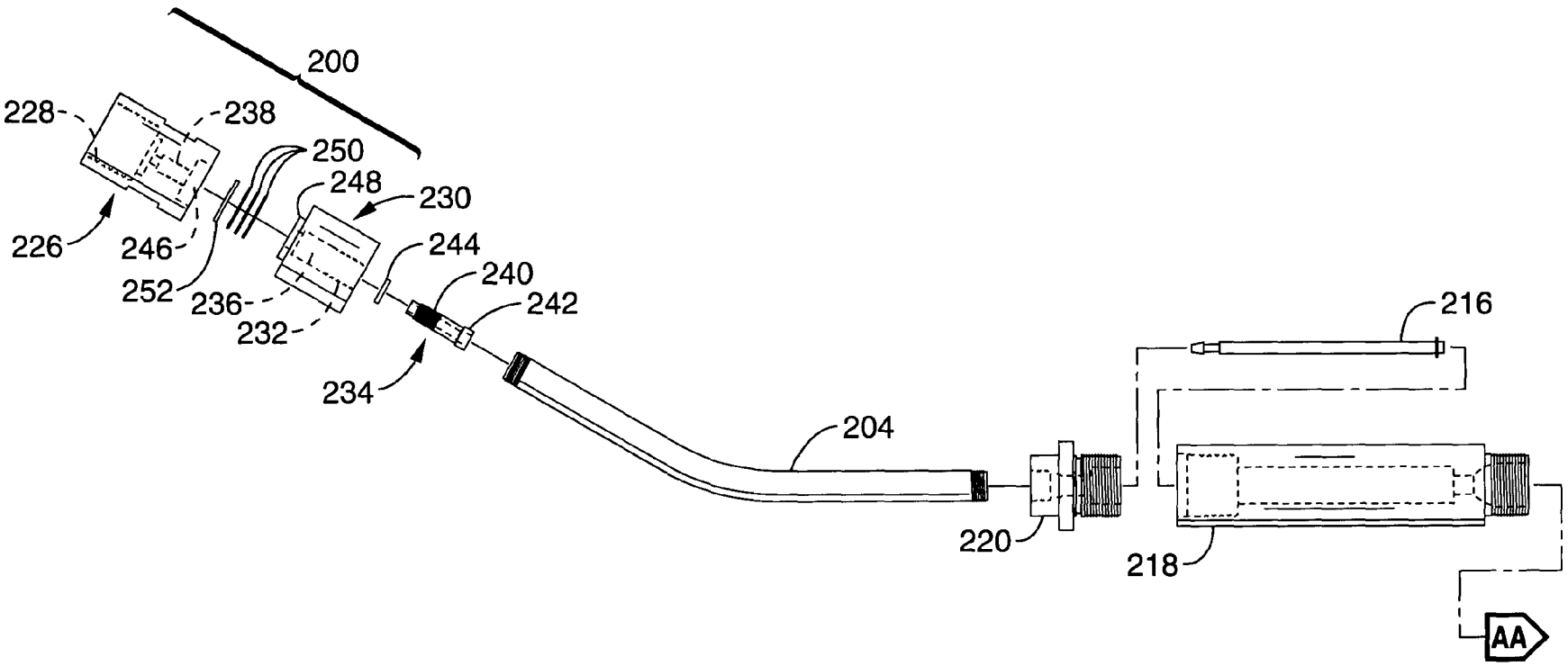
FIG. 17A and FIG. 17B are a detailed partial exploded view of the assembly of FIG. 15.
Figure 17B:
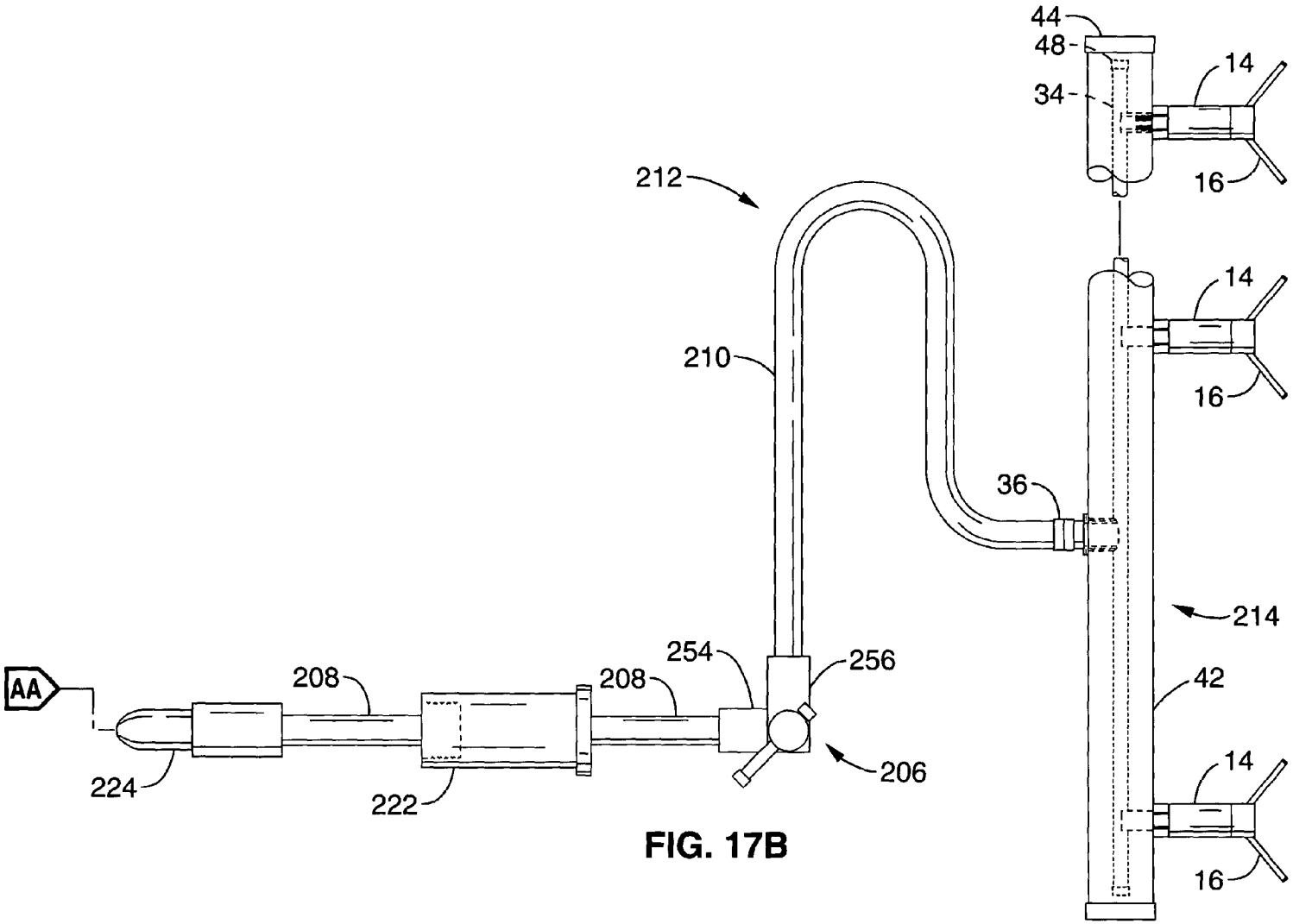
Figure 18:
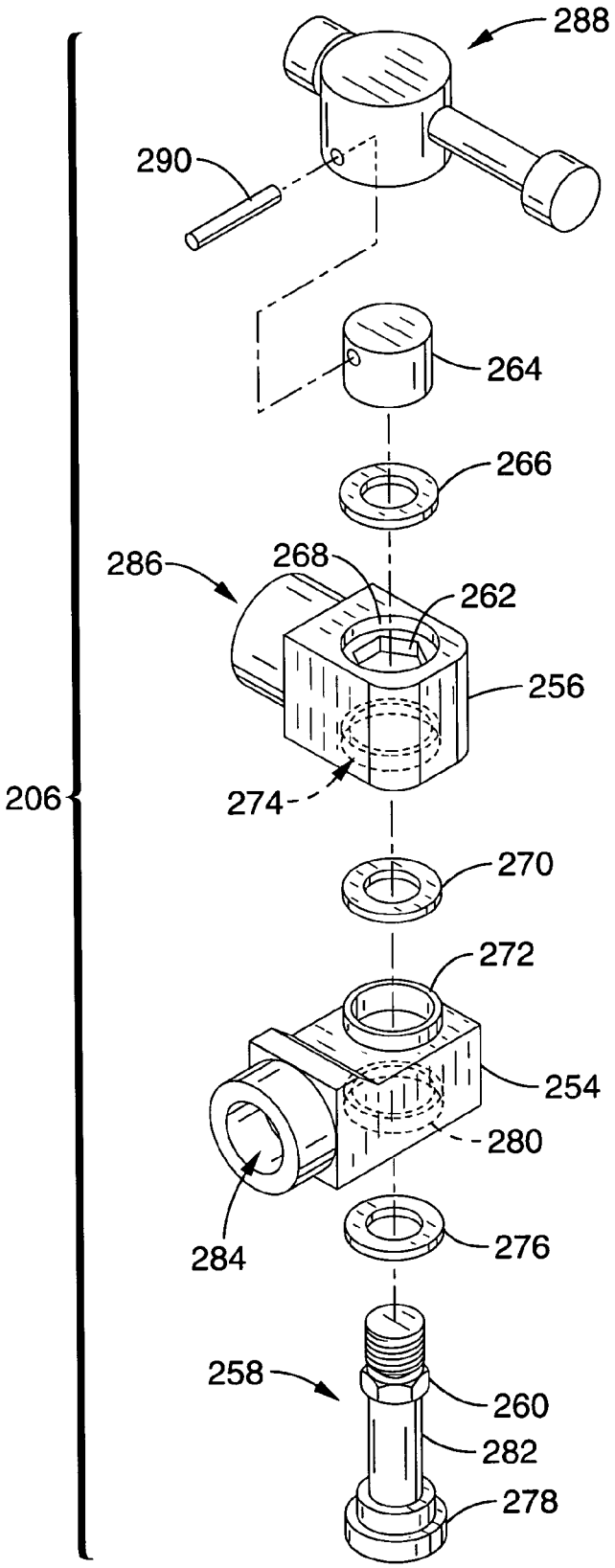
FIG. 18 is an exploded view of the spray head angle swivel portion of the apparatus shown in FIG. 15.

FIG. 16 through FIG. 18 show additional details of preferred embodiments of various components used in this embodiment as will now be described.

For example, referring to FIG. 16, FIG. 17A and FIG. 17B, it can be seen that filter assembly 202 is an adaptation of quick connect coupling 26 that houses a replaceable screen filter cartridge 216 in a filter housing 218. In this regard, note that filter cartridge 216 can be a standard spring loaded paint spray gun filter cartridge or the like. Referring also to FIG. 10, it can be seen that filter housing 218 is essentially an elongated version of base 110 that has been adapted to accommodate filter cartridge 216. Filter assembly 202 includes a threaded plug 220 for retaining filter cartridge 216 and connecting filter housing 218 to feed tubing 204 (similar to threaded plug 132), and a threaded coupling collar 222 for connecting filer housing 218 to feed tubing 208 via a seal 224 (similar to seal 112 and coupling collar 114).

Referring to FIG. 16 and FIG. 17B, line swivel 200 comprises an adapter 226 having internal threads 228 for connecting to, for example, adapter tube 32 (see FIG. 1). Line swivel 200 also comprises a coupling 230 having internal threads 232 for connecting to, for example, feed tube section 204. To couple the two components together, a hollowed out threaded swivel screw 234 is inserted into opening 236 in coupling 230 and threaded into adapter 226. Adapter 226 includes internal threads 238 that mate with external threads 240 on swivel screw 234. Note that when these components are assembled, swivel screw 234 extends through coupling 230 and the head 242 of swivel screw 234 bottoms out in coupling 230 with a Delrin® washer 244 or the like therebetween. Adapter 226 also includes a recess 246 that receives a neck portion 248 of coupling 230, between which are seated a plurality of spring washers 250 (e.g., disc springs) or the like and a Delrin® sealing washer 252 or the like that facilitate rotational motion.

Referring now to FIG. 18, a preferred embodiment of spray head angle swivel 206 can be seen in more detail. In the embodiment shown, spray head angle swivel 206 comprises an upper body portion 254 and a lower body portion 256 which are adapted for relative rotational motion. This is accomplished by inserting a stud 258 through lower body portion 254 and into upper body portion 256 so that a non-circular (e.g. hex) shaped shoulder 260 on stud 258 seats into a corresponding recess 262 in upper body portion 256, and threads on the end of stud 258 are engaged by a threaded cap nut 264. In this way, lower body portion 252 can swivel about stud 258 in relation to upper body portion 256. A washer 266 is positioned between cap nut 264 and upper body portion 256 in a recess 268, a washer 270 is positioned between the neck 272 of lower body portion 254 and upper body portion 256 in a recess 274, and a washer 276 is positioned between the head 278 of stud 258 and lower body portion 254 in a recess 280. Each of these washers is preferably made from Delrin® or like material. Note that swivel 206 is also a fluidic coupling and, therefore, the shank portion 282 of stud 258 has a reduced diameter around which paint can flow between inlet 284 and outlet 286, to which feed tubing sections 208, 210, respectively, would be welded or preferably threadably attached. Lastly, to facilitate loosening, tightening, and disassembly of these components, a cap handle assembly 288 is coupled to cap nut 264 with a pin 290 or the like.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A handheld apparatus for spraying a fluid material, comprising:

a plurality of spray nozzles;

a manifold supporting said spray nozzles;

a feed tube coupled to said manifold;

said feed tube having at least a portion positioned at an offset angle in relation to a longitudinal axis through said manifold; and an adapter configured for coupling said feed tube to a flow control valve;

wherein said portion of said feed tube positioned at an offset angle forms a handle; and wherein said apparatus is adapted to be supported with one hand gripping a flow control valve and the other hand gripping said handle.

2. An apparatus as recited in claim 1, wherein said handle includes an arcuate section.

3. An apparatus as recited in claim 1, wherein said offset angle is fixed.

4. An apparatus as recited in claim 1, wherein said offset angle is adjustable.

5. An apparatus as recited in claim 4, further comprising means for adjusting said offset angle.

6. An apparatus as recited in claim 5, further comprising an arcuate section of feed tubing said means for adjusting said offset angle and said manifold.

7. An apparatus as recited in claim 5 or 6, wherein said means for adjusting said offset angle comprises a swivel adapted for internal fluid flow through said swivel.

8. An apparatus as recited in claim 1, further comprising:

means fluidically coupled to at least one said nozzle for receiving a pressurized fluid, allowing said fluid to flow when the pressure of the fluid exceeds a bias level, and preventing fluid flow when the pressure of the fluid falls below the bias level.

9. An apparatus as recited in claim 8, wherein said means for receiving a pressurized fluid, allowing said fluid flow to flow when the pressure of the fluid exceeds a bias level, and preventing fluid flow when the pressure of the fluid falls below the bias level, comprises:

a valve body;

said valve body having an intake port, a central channel and an output port;

a valve seat disposed within said central channel; and a biased valve head;

said valve head configured to allow fluid to flow between said intake port and said output port when the pressure of said fluid is sufficient to overcome the bias on said valve head;

said valve head configured to engage said valve seat when the pressure of the flow of fluid drops to a level insufficient to overcome the bias on said valve head.

10. An apparatus as recited in claim 9, further comprising:

means for increasing and decreasing said bias level on said valve head.

11. An apparatus as recited in claim 10, wherein said means for increasing and decreasing the bias on said valve head comprises:

a spring configured to be adjustably compressed; and means for adjusting the compression of said spring.

12. An apparatus as recited in claim 11, wherein said means for adjusting the compression of said spring comprises a rotatable member positioned in said valve body.

13. A handheld apparatus for spraying a fluid material, comprising:

a plurality of spray nozzles;

a manifold supporting said spray nozzles;

a feed tube coupled to said manifold;

said feed tube having a least a portion positioned at an offset angle in relation to a longitudinal axis through said manifold;

an adapter configured for coupling said feed tube to a flow control valve;

wherein said portion of said feed tube positioned at an offset angle forms a handle;

wherein said apparatus is adapted to be supported with one hand gripping a flow control valve and the other hand gripping said handle; and means fluidically coupled to at least one said spray nozzle for receiving a pressurized fluid, allowing said fluid to flow when the pressure of the fluid exceeds a bias level, and preventing fluid flow when the pressure of the fluid falls below the bias level.

14. An apparatus as recited in claim 13, wherein said means for receiving a pressurized fluid, allowing said fluid flow to flow when the pressure of the fluid exceeds a bias level, and preventing fluid flow when the pressure of the fluid falls below the bias level, comprises:

a valve body;

said valve body having an intake port, a central channel and an output port;

a valve seat disposed within said central channel; and a biased valve head;

said valve head configured to allow fluid to flow between said intake port and said output port when the pressure of said fluid is sufficient to overcome the bias on said valve head;

said valve head configured to engage said valve seat when the pressure of the flow of fluid drops to a level insufficient to overcome the bias on said valve head.

15. An apparatus as recited in claim 14, further comprising:

means for increasing and decreasing said bias level on said valve head.

16. An apparatus as recited in claim 15, wherein said means for increasing and decreasing the bias on said valve head comprises:

a spring configured to be adjustably compressed; and means for adjusting the compression of said spring.

17. An apparatus as recited in claim 16, wherein said means for adjusting the compression of said spring comprises a rotatable member positioned in said valve body.

18. An apparatus as recited in claim 13, wherein said handle includes an arcuate section.

19. An apparatus as recited in claim 13, wherein said offset angle is fixed.

20. An apparatus as recited in claim 13, wherein said offset angle is adjustable.

21. An apparatus as recited in claim 20, further comprising means for adjusting said offset angle.

22. An apparatus as recited in claim 21, further comprising an arcuate section of feed tubing said means for adjusting said offset angle and said manifold.

23. An apparatus as recited in claim 21 or 22, wherein said means for adjusting said offset angle comprises a swivel adapted for internal fluid flow through said swivel.

24. A handheld apparatus for spraying a fluid material, comprising:

a plurality of spray nozzles;

a manifold supporting said spray nozzles;

a feed tube coupled to said manifold;

said feed tube having a least a portion positioned at an offset angle in relation to a longitudinal axis through said manifold;

an adapter configured for coupling said feed tube to a flow control valve;

wherein said portion of said feed tube positioned at an offset angle forms a handle;

wherein said apparatus is adapted to be supported with one hand gripping a flow control valve and the other hand gripping said handle; and an anti-sputter flow control mechanism fluidically coupled to at least one said spray nozzle;

said at least one anti-sputter flow control mechanism comprising (i) a valve body having an intake port, a central channel and an output port, (ii) a valve seat disposed within said central channel, and (iii) a biased valve head configured to allow fluid to flow between said intake port and said output port when the pressure of said fluid is sufficient to overcome the bias on said valve head, and further configured to engage said valve seat when the pressure of the flow of fluid drops to a level insufficient to overcome the bias on said valve head.

25. An apparatus as recited in claim 24, further comprising:

means for increasing and decreasing said bias level on said valve head.

26. An apparatus as recited in claim 25, wherein said means for increasing and decreasing the bias on said valve head comprises:

a spring configured to be adjustably compressed; and means for adjusting the compression of said spring.

27. An apparatus as recited in claim 26, wherein said means for adjusting the compression of said spring comprises a rotatable member positioned in said valve body.

28. An apparatus as recited in claim 24, wherein said handle includes an arcuate section.

29. An apparatus as recited in claim 24, wherein said offset angle is fixed.

30. An apparatus as recited in claim 24, wherein said offset angle is adjustable.

31. An apparatus as recited in claim 30, further comprising means for adjusting said offset angle.

32. An apparatus as recited in claim 31, further comprising an arcuate section of feed tubing said means for adjusting said offset angle and said manifold.

33. An apparatus as recited in claim 31 or 32, wherein said means for adjusting said offset angle comprises a swivel adapted for internal fluid flow through said swivel.

34. An apparatus as recited in claim 1, 13 or 24, further comprising means for coupling and decoupling said handle to a source of pressurized fluid.

35. An apparatus as recited in claim 34, wherein said means for coupling and decoupling said handle to a source of pressurized fluid comprises a separable union.

36. An apparatus as recited in claim 35, wherein said union comprises:

a base member having an axial bore;

a seal having an axial bore; and a collar configured to reversibly couple with said base member to facilitate alignment of said bores and engagement of said seal and said base member.

37. An apparatus as recited in claim 36, wherein said seal has at least one frustoconical surface.

38. An apparatus as recited in claim 36, further comprising a filter positioned within said base member.

39. A handheld apparatus for spraying a fluid material, comprising:

a plurality of spray nozzles;

a manifold supporting said spray nozzles;

a feed tube coupled to said manifold;

said feed tube having at least a portion positioned at an offset angle in relation to a longitudinal axis through said manifold;

means for coupling and decoupling said feed tube to a source of pressurized fluid;

wherein said means for coupling and decoupling said feed tube to a source of pressurized fluid comprises a separable union;

wherein said union comprises:

(i) a base member having an axial bore;

(ii) a seal having an axial bore; and (iii ) a collar configured to reversibly couple with said base member to facilitate alignment of said bores and engagement of said seal and said base member.

40. An apparatus as recited in claim 39, further comprising:

means fluidically coupled to at least one said spray nozzle for receiving a pressurized fluid, allowing said fluid to flow when the pressure of the fluid exceeds a bias level, and preventing fluid flow when the pressure of the fluid falls below the bias level.

41. An apparatus as recited in claim 40, wherein said means for receiving a pressurized fluid, allowing said fluid flow to flow when the pressure of the fluid exceeds a bias level, and preventing fluid flow when the pressure of the fluid falls below the bias level, comprises:

a valve body;

said valve body having an intake port, a central channel and an output port;

a valve seat disposed within said central channel; and a biased valve head;

said valve head configured to allow fluid to flow between said intake port and said output port when the pressure of said fluid is sufficient to overcome the bias on said valve head;

said valve head configured to engage said valve seat when the pressure of the flow of fluid drops to a level insufficient to overcome the bias on said valve head.

42. An apparatus as recited in claim 39, further comprising:

an anti-sputter flow control mechanism fluidically coupled to at least one said spray nozzle;

said at least one anti-sputter flow control mechanism comprising (i) a valve body having an intake port, a central channel and an output port, (ii) a valve seat disposed within said central channel, and (iii) a biased valve head configured to allow fluid to flow between said intake port and said output port when the pressure of said fluid is sufficient to overcome the bias on said valve head, and further configured to engage said valve seat when the pressure of the flow of fluid drops to a level insufficient to overcome the bias on said valve head.

43. An apparatus as recited in claim 39, 40 or 42, wherein said seal has at least one frustoconical surface.

44. An apparatus as recited in claim 39, 40 or 42, further comprising a filter positioned within said base member.

* * * * *